US010317819B2

(12) United States Patent
Koga

(10) Patent No.: US 10,317,819 B2
(45) Date of Patent: Jun. 11, 2019

(54) DEVELOPER SUPPLYING DEVICE AND IMAGE FORMING APPARATUS

(71) Applicant: CANON KABUSHIKI KAISHA, Tokyo (JP)

(72) Inventor: Yutaka Koga, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/644,028

(22) Filed: Jul. 7, 2017

(65) Prior Publication Data

US 2018/0017894 A1 Jan. 18, 2018

(30) Foreign Application Priority Data

Jul. 13, 2016 (JP) ..... 2016-138698

(51) Int. Cl.
*G03G 15/08* (2006.01)

(52) U.S. Cl.
CPC ..... *G03G 15/0891* (2013.01); *G03G 15/0889* (2013.01)

(58) Field of Classification Search
CPC ..... G03G 15/0891
See application file for complete search history.

(56) References Cited

U.S. PATENT DOCUMENTS

| | | | |
|---|---|---|---|
| 9,360,798 B2 | 6/2016 | Amauchi et al. | |
| 9,658,569 B2 | 5/2017 | Kayahara | |
| 2011/0158669 A1* | 6/2011 | Kayahara | G03G 15/0872 399/53 |

FOREIGN PATENT DOCUMENTS

| | | |
|---|---|---|
| JP | 2006-251549 A | 9/2006 |
| JP | 2011-150308 A | 8/2011 |
| JP | 4916039 B2 | 4/2012 |
| JP | 2014-74890 A | 4/2014 |

* cited by examiner

*Primary Examiner* — G. M. A Hyder
(74) *Attorney, Agent, or Firm* — Venable LLP

(57) ABSTRACT

A developer supplying device includes a supply driving portion supplying a developer from a developer supplying container to a developer accommodating portion, where it is agitated by an agitating conveyance portion. An agitating driving portion drives the agitating conveyance portion, and a control portion controls the supply driving portion and the agitating driving portion such that, each time the agitating conveyance portion is driven by a first driving amount, the supply driving portion is driven by a second driving amount. The control portion sets a different value of the first driving amount in accordance with a supplying property in a case where the developer is supplied from the developer supplying container to the developer accommodating portion.

9 Claims, 20 Drawing Sheets

DEVELOPER SUPPLYING DEVICE AND IMAGE FORMING APPARATUS

BACKGROUND OF THE INVENTION

Field of the Invention

The present invention is related to a developer supplying device capable of supplying developer to, for example, a developing unit, and is related to an image forming apparatus including the developer supplying device, examples of the image forming apparatus including a copier, a printer, a facsimile machine, and a multifunctional machine having functions of these machines.

Description of the Related Art

A configuration including a toner cartridge and a hopper as a developer supplying device that supplies developer to a developing unit is known. The hopper temporarily accommodates developer supplied from the toner cartridge and then supplies the developer to the developing unit. In this configuration, a sensor that detects developer in the hopper is provided, and the developer is supplied from the toner cartridge to the hopper on the basis of a result of detection by the sensor.

In such a configuration, developer is sometimes not detected by the sensor due to an influence of the fluidity of the developer supplied from the toner cartridge even in the case where the developer has been supplied from the toner cartridge into the hopper. In this case, even if developer remains in the toner cartridge, a control portion of the device will determine that the toner cartridge needs to be replaced. Therefore, Japanese Patent No. 4916039 proposes a configuration in which an agitating member that agitates the developer in the hopper is driven, before performing the determination concerning replacement of the toner cartridge, to level the developer in the hopper and make it easier for the sensor to detect the developer.

However, it sometimes takes time to cause the sensor to detect the developer even in the case where an agitating member is driven before performing the determination concerning replacement of the toner cartridge as in the configuration disclosed in Japanese Patent No. 4916039. That is, when developer is supplied from the toner cartridge into the hopper, a heap of developer is formed in the hopper in accordance with the fluidity of the developer. The developer can be detected by the sensor by leveling the heap, and the state of the heap varies depending on the fluidity of the developer at the time of leveling. In particular, a supply property, or a discharge property, of the toner cartridge to supply developer from the toner cartridge to the hopper varies depending on the amount of remaining developer in the toner cartridge. Therefore, a large heap is sometimes formed in the hopper depending on the supply property of the toner cartridge or the fluidity of the developer at the time of supply. In the case where a large heap of developer is formed, the agitating member is driven for a long period to level the heap and cause the sensor to detect the developer.

In the case where the agitating member is driven for a long period to cause the sensor to detect the developer, deterioration of the developer is accelerated. It can be also considered to drive the agitating member the whole time, that is, also in other time than before performing the determination concerning replacement of the toner cartridge. However, deterioration of the developer is also accelerated in this case.

SUMMARY OF THE INVENTION

According to a first aspect to the invention, a developer supplying device includes a developer supplying container configured to accommodate developer and attachable to and detachable from an image forming apparatus, a developer accommodating portion including a discharge port and configured to accommodate the developer supplied from the developer supplying container, the discharge port being configured such that the developer in the developer accommodating portion is discharged through the discharge port, a supply driving portion configured to perform a supply operation of supplying the developer from the developer supplying container to the developer accommodating portion, a developer detection portion configured to detect the developer in the developer accommodating portion, an agitating conveyance portion configured to agitate the developer in the developer accommodating portion and convey the developer in the developer accommodating portion to the discharge port, an agitating driving portion configured to drive the agitating conveyance portion, and, a control portion including a processor and configured to control the supply driving portion and the agitating driving portion such that the supply operation is performed in a case where the developer is not detected by the developer detection portion and such that, each time the agitating conveyance portion is driven by a first driving amount, the supply driving portion is driven by a second driving amount in the supply operation. The control portion is configured to set a different value of the first driving amount on a basis of an amount of remaining developer in the developer supplying container.

According to a second aspect to the invention, a developer supplying device includes a developer supplying container configured to accommodate developer and attachable to and detachable from an image forming apparatus, a developer accommodating portion including a discharge port and configured to accommodate the developer supplied from the developer supplying container, the discharge port being configured such that the developer in the developer accommodating portion is discharged through the discharge port, a supply driving portion configured to perform a supply operation of supplying the developer from the developer supplying container to the developer accommodating portion, a developer detection portion configured to detect the developer in the developer accommodating portion, an agitating conveyance portion configured to agitate the developer in the developer accommodating portion and convey the developer in the developer accommodating portion to the discharge port, an agitating driving portion configured to drive the agitating conveyance portion, and, a control portion including a processor and configured to control the supply driving portion and the agitating driving portion such that the supply operation is performed in a case where the developer is not detected by the developer detection portion and such that, each time the agitating conveyance portion is driven by a first driving amount, the supply driving portion is driven by a second driving amount in the supply operation. The control portion is configured to set a different value of the first driving amount on a basis of an amount of developer supplied from the developer supplying container to the developer accommodating portion per unit time.

According to a third aspect to the invention, a developer supplying device includes a developer supplying container configured to accommodate developer and attachable to and detachable from an image forming apparatus, a developer accommodating portion including a discharge port and configured to accommodate the developer supplied from the developer supplying container, the discharge port being configured such that the developer in the developer accommodating portion is discharged through the discharge port, a supply driving portion configured to perform a supply operation of supplying the developer from the developer supplying container to the developer accommodating portion, a developer detection portion configured to detect the developer in the developer accommodating portion, an agitating conveyance portion configured to agitate the developer in the developer accommodating portion and convey the developer in the developer accommodating portion to the discharge port, an agitating driving portion configured to drive the agitating conveyance portion, and a control portion including a processor and configured to control the supply driving portion and the agitating driving portion such that the supply operation is performed in a case where the developer is not detected by the developer detection portion and such that, each time the agitating conveyance portion is driven by a first driving amount, the supply driving portion is driven by a second driving amount in the supply operation. The control portion is configured to set a different value of the first driving amount in accordance with a supplying property in a case where the developer is supplied from the developer supplying container to the developer accommodating portion.

Further features of the present invention will become apparent from the following description of exemplary embodiments with reference to the attached drawings.

DESCRIPTION OF THE EMBODIMENTS

First Exemplary Embodiment

Figure 1:
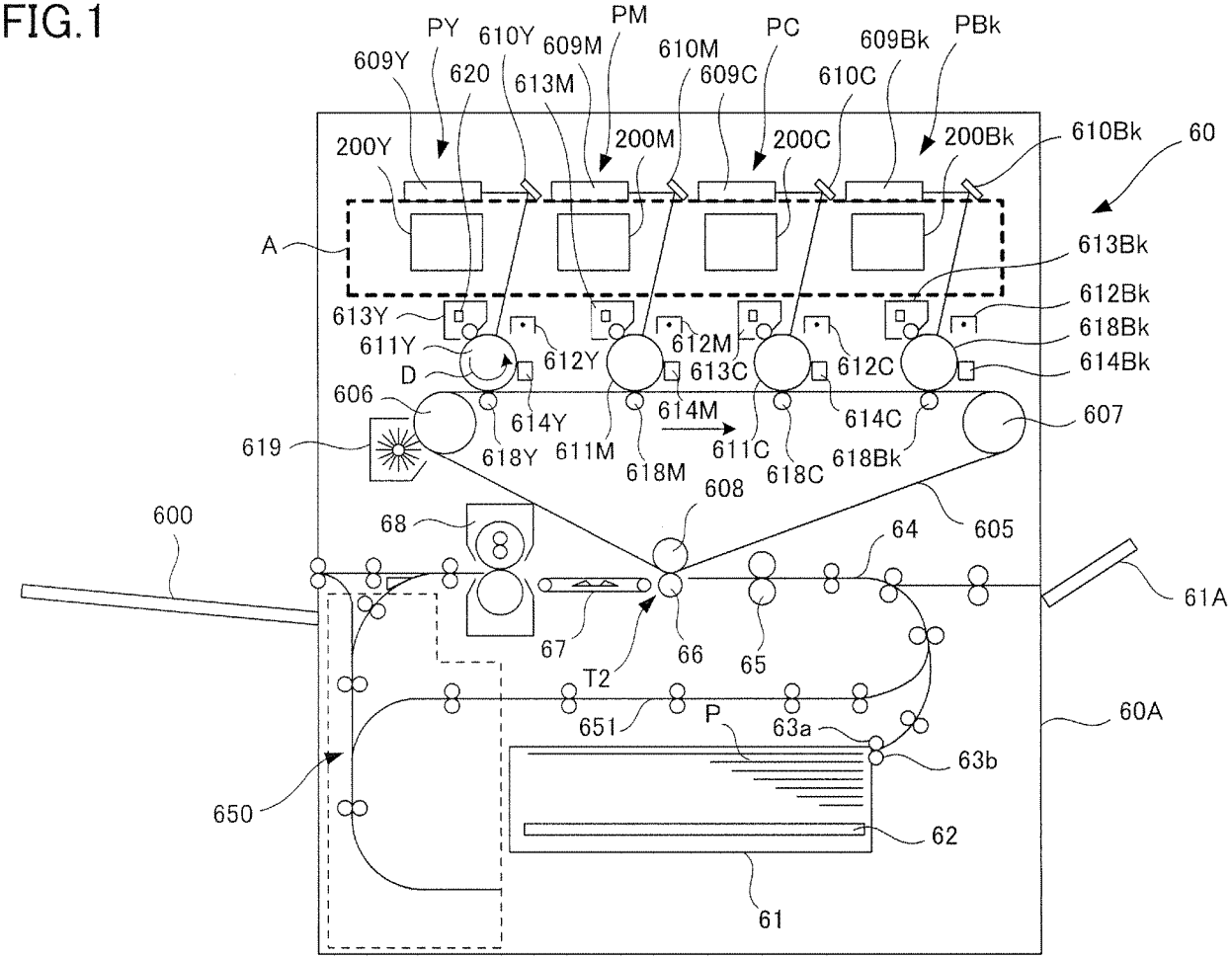
FIG. 1 is a schematic configuration diagram of an image forming apparatus according to a first exemplary embodiment.

A first exemplary embodiment will be described with reference to FIGS. 1 to 17. First, a schematic configuration of an image forming apparatus according to the present exemplary embodiment will be described with reference to FIG. 1.

Image Forming Apparatus

An image forming apparatus 60 is a color image forming apparatus employing an electrophotographic system, and is an image forming apparatus of a so-called intermediate transfer tandem type in which image forming portions PY, PM, PC, and PBk of four colors are arranged above an intermediate transfer belt 605. In the image forming apparatus 60 having such a configuration, toner images formed by respective image forming portions are transferred onto a recording material to form a full-color toner image on the recording material. Examples of the recording material include sheet materials such as paper sheets, plastic films, and cloth.

Conveyance Process of Recording Material

First, a conveyance process of the recording material will be described. A recording material P is accommodated in a cassette 61 and is supported on a lift-up device 62 in the cassette 61. The recording material P in the cassette 61 is conveyed to a conveyance path 64 by a feed roller 63*a* at a timing matching a timing of image formation. There is a case where a recording material P is conveyed into the conveyance path 64 from a manual feed tray 61A provided on a side surface of an apparatus body 60A of the image forming apparatus 60. In addition, in the case where plural recording materials P are accommodated in the cassette 61, one recording material P is separated from the other recording materials P by a frictional force of a separation roller 63*b* and conveyed by the feed roller 63*a*.

The recording material P sent out by the feed roller 63*a* passes through the conveyance path 64, and is conveyed to registration rollers 65. The registration rollers 65 are devices for matching relative positions of the recording material P and a toner image on an intermediate transfer belt 605, and convey the recording material P to a secondary transfer portion T2 after performing skew correction and timing correction of the recording material P. The secondary transfer portion T2 is a transfer nip portion formed by two opposing rollers of a secondary transfer inner roller 608 and a secondary transfer outer roller 66, and a toner image on the intermediate transfer belt 605 is transferred onto the recording material P at the secondary transfer portion T2 by being subjected to a predetermined pressurizing force and a predetermined electrostatic load bias.

Image Formation Process

Next, an image formation process of a toner image conveyed to the secondary transfer portion T2 at a timing matching the conveyance process of the recording material P to the secondary transfer portion T2 described above will be described. The image forming portions PY, PM, PC, and PBk respectively form toner images of yellow, magenta, cyan, and black. Hereinafter, correspondence with these colors will be also respectively indicated by reference letters Y, M, C, and Bk. The image forming portions PY, PM, PC, and PBk all have substantially the same configurations except that colors used for development are different. Therefore, the image forming portion PY will be described as a representative, and description of components of the other image forming portions will be omitted by just adding reference letters M, C, and Bk indicating the correspondence of the components with the image forming portions.

The image forming portion PY is mainly constituted by a photosensitive drum 611Y, a charging unit 612Y, an exposing unit 609Y, a developing unit 613Y, a primary transfer roller 618Y, a drum cleaner 614Y, and so forth. The photosensitive drum 611Y is a photoconductor serving as an image bearing member. The surface of the photosensitive drum 611Y is uniformly charged by the charging unit 612Y in advance, and the photosensitive drum 611Y rotates in an arrow D direction in FIG. 1. The exposing unit 609Y is driven, on the basis of a signal of image information transmitted thereto, to expose, through a diffraction portion 610Y as appropriate, the rotating photosensitive drum 611Y to form an electrostatic latent image. The electrostatic latent image formed on the photosensitive drum 611Y is developed by the developing unit 613Y with toner serving as developer, and is visualized as a toner image on the photosensitive drum 611Y.

Then, a predetermined pressurizing force and a predetermined electrostatic load bias are applied by the primary transfer roller 618Y, and the toner image on the photosensitive drum 611Y is transferred onto the intermediate transfer belt 605 through primary transfer. Transfer residual toner remaining on the photosensitive drum 611Y by a small amount after the primary transfer is collected by the drum cleaner 614Y for preparation for the next image formation.

Next, the intermediate transfer belt 605 will be described. The intermediate transfer belt 605 is stretched by rollers such as a driving roller 606, a tension roller 607, and the secondary transfer inner roller 608, and is driven in an arrow direction in FIG. 1. Image formation processes of respective colors are performed in parallel by the image forming portions PY, PM, PC, and PBk at such timings that each downstream toner image is superimposed on each upstream toner image transferred onto the intermediate transfer belt 605 through primary transfer. As a result, a full-color toner image is finally formed on the intermediate transfer belt 605, and is conveyed to the secondary transfer portion T2.

Process of Secondary Transfer and Subsequent Processes

According to the conveyance process of the recording material P and the image formation process described above, a full-color toner image is transferred onto the recording material P through secondary transfer at the secondary transfer portion T2. Transfer residual toner remaining on the intermediate transfer belt 605 by a small amount after the secondary transfer is collected by a belt cleaner 619. Then, the recording material P is conveyed to a fixing unit 68 by a pre-fixing conveyance portion 67. The fixing unit 68 applies a predetermined pressurizing force by opposing rollers, belts, or the like and heat by a heat source such as a heater to melt and fix the toner image on the recording material P. The recording material P bearing a fixed image obtained in this way is discharged onto a discharge tray 600. In the case of forming images on both surfaces of the recording material P, the recording material P is again conveyed to the secondary transfer portion T2 by an inversion conveyance device 650 through a duplex conveyance path 651.

Supply of Developer to Developing Unit

In the case where image formation is performed as described above, toner in developing units 613Y, 613M, 613C, and 613Bk is consumed. Therefore, toners of respective colors are replenished by developer supplying devices 200Y, 200M, 200C, and 200Bk to the developing units 613Y, 613M, 613C, and 613Bk. In the present exemplary embodiment, two-component developer including nonmagnetic toner and magnetic carrier is used as the developer.

Therefore, a toner density is detected by an inductance sensor 620 serving as a density detection portion and provided in each of the developing units 613Y, 613M, 613C, and 613Bk corresponding to respective colors. In addition, developer is supplied from the developer supplying devices 200Y, 200M, 200C, and 200Bk to the developing units 613Y, 613M, 613C, and 613Bk on the basis of a result of detection by the inductance sensor 620. The developer that is supplied may be only toner or include toner and carrier. A case where the developer that is supplied is toner will be described below.

Developer may be supplied in accordance with an amount of toner consumed in image formation instead of with the result of detection by the inductance sensor 620. For example, developer may be supplied on the basis of a video count value obtained by integrating a level of each pixel in image information corresponding to one image. For example, the level is in a range of 0 to 255 levels. In addition, developer may be supplied by forming an image for control, for example, a patch image, on a photosensitive drum or the intermediate transfer belt 605 and detecting the density of the patch image.

Developer Supplying Device

Next, configurations of the developer supplying devices 200Y, 200M, 200C, and 200Bk described above will be described. A developer supplying portion A including the developer supplying devices 200Y, 200M, 200C, and 200Bk is attached to an upper portion of a back surface of the apparatus body 60A as illustrated in FIG. 1. The developer supplying devices 200Y, 200M, 200C, and 200Bk have substantially the same configurations except that the colors of toner are different. Therefore, the developer supplying device 200Y will be described as a representative, and description of the other developer supplying devices will be omitted.

Figure 2:
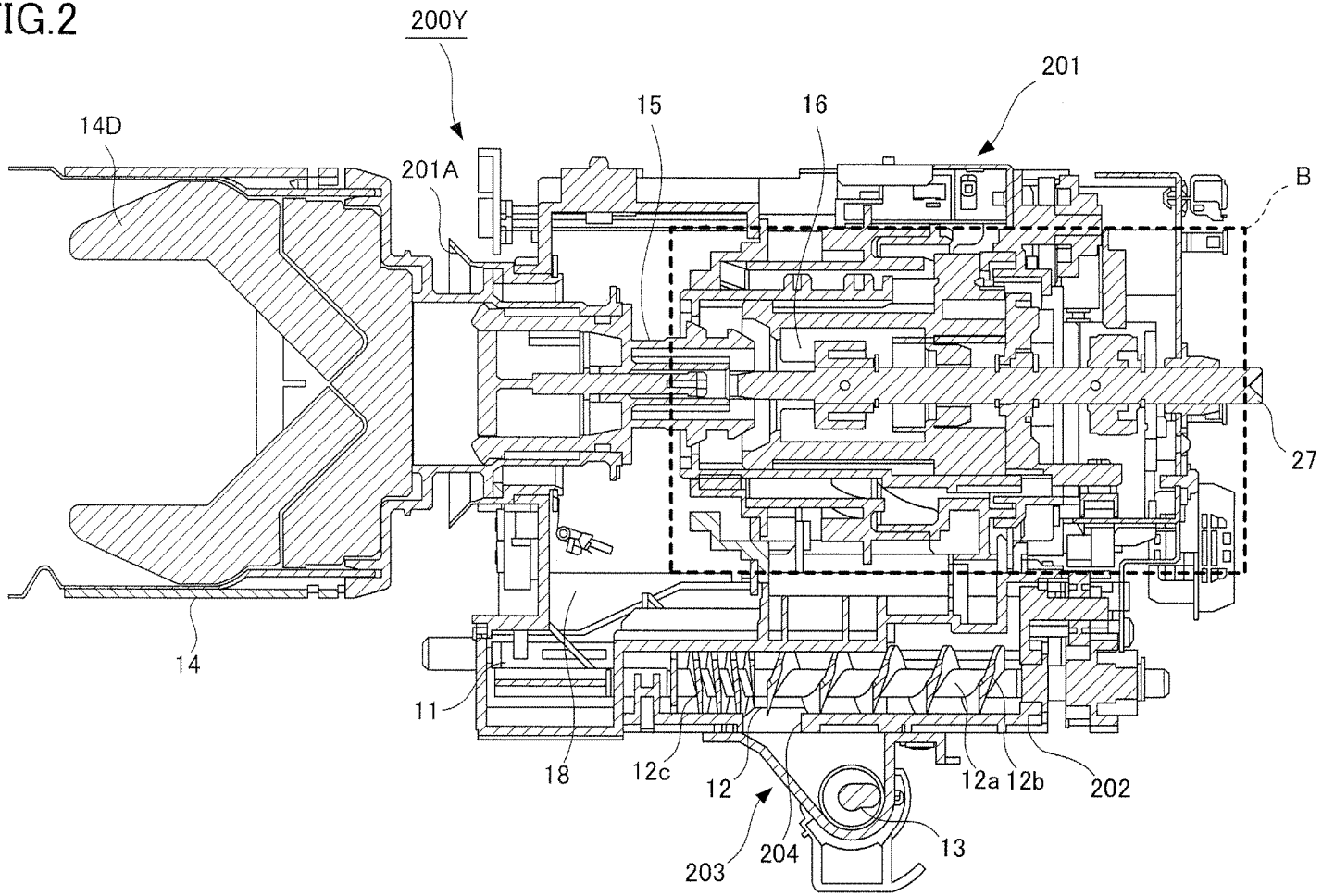
FIG. 2 is a section view of a developer supplying device according to the first exemplary embodiment.

The developer supplying device 200Y includes a toner cartridge 14 and a hopper 201 as illustrated in FIG. 2. The toner cartridge 14 serves as a developer supplying container configured to accommodate toner serving as developer. The hopper 201 includes a container 202 serving as a developer accommodating portion and including a discharge port 206 illustrated in FIG. 12, and developer is supplied to the container 202 from the toner cartridge 14. In addition, the hopper 201 is capable of supplying the developer to the developing unit 613Y. That is, functions of the developer supplying device 200Y include supply of toner to the developing unit 613Y and supply of toner to the hopper 201 from the toner cartridge 14. The developer supplying device 200Y is disposed above the developing unit 613Y to facilitate supply of toner to the developing unit 613Y.

In the developer supplying device 200Y, a tip end portion of the toner cartridge 14 is set at a receiving port 201A of the hopper 201 as illustrated in FIG. 2. The developer supplying device 200Y is configured such that a toner storage portion 18 of the container 202 stores the toner supplied from the toner cartridge 14, and an agitating conveyance portion 203 in the hopper 201 agitates and conveys the stored toner to the developing unit 613Y. That is, the agitating conveyance portion 203 agitates the developer in the container 202 and conveys the developer in the container 202 to the discharge port 206. Therefore, the agitating conveyance portion 203 includes agitating screws 11, a first screw 12, and a second screw 13. The configuration and operation of the agitating conveyance portion 203 will be described later in detail.

In addition, the hopper 201 includes a supply port opening/closing mechanism B. The supply port opening/closing mechanism B includes a motor 21, a drive transmission portion 19, a cam gear 19A, and an engagement member 16. The motor 21 serves as a drive source. When toner is supplied from the toner cartridge 14, the engagement member 16 of the supply port opening/closing mechanism B is engaged with the cap 15 provided at the tip end of the toner cartridge 14 in a manner that will be described below. As a result of this, the cap 15 is openable and closable, and the toner cartridge 14 is rotatable. As will be described later in detail, in the present exemplary embodiment, toner can be supplied from the toner cartridge 14 to the hopper 201 by rotating the toner cartridge 14. Details of each component will be sequentially described below.

Figure 6:
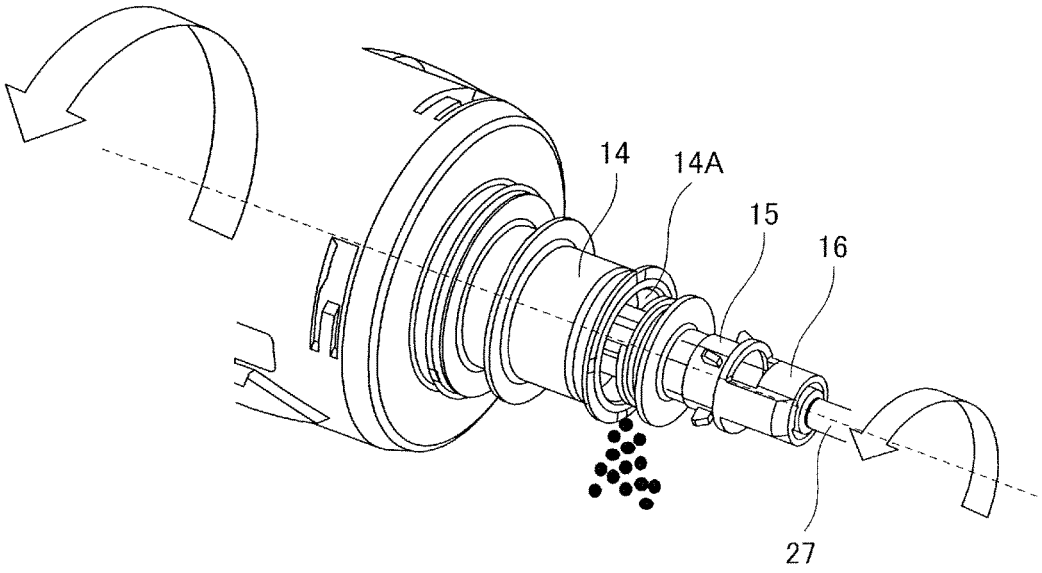
FIG. 6 is a perspective view of the toner cartridge according to the first exemplary embodiment illustrating how toner is discharged therefrom.

First, a function of supplying toner from the toner cartridge 14 to the hopper 201 will be described. The cap 15 is provided at the tip end of the toner cartridge 14 so as to be movable parallel to a rotational axis direction serving as an axial direction of the toner cartridge 14. A supply port 14A illustrated in FIG. 6 provided at the tip end of the toner cartridge 14 can be opened and closed by the movement of the cap 15 in the axial direction. The supply port 14A of the toner cartridge 14 is normally closed by the cap 15, and cannot be easily opened by a user.

Figure 3:
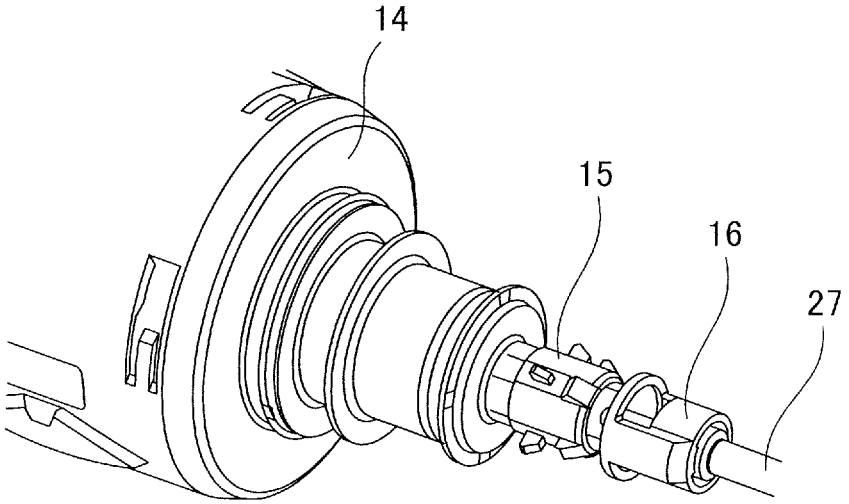
FIG. 3 is a perspective view of a toner cartridge and a cap according to the first exemplary embodiment.

The user sets the toner cartridge 14 at a predetermined position in the apparatus body 60A while inserting the tip end of the toner cartridge 14 in the receiving port 201A of the hopper 201. At this time, the cap 15 provided at the tip end of the toner cartridge 14 is not engaged with the engagement member 16 of the supply port opening/closing mechanism B as illustrated in FIG. 3, and thus toner cannot be supplied from the toner cartridge 14 to the hopper 201. Next, in the case where the user having securely set the toner cartridge 14 is detected by an unillustrated sensor, a control portion 100 illustrated in FIG. 14 drives the supply port opening/closing mechanism B to open the cap 15 provided at the tip end of the toner cartridge 14. The control portion 100 is provided in the apparatus body 60A, and controls each component of the image forming apparatus 60.

Figure 4:
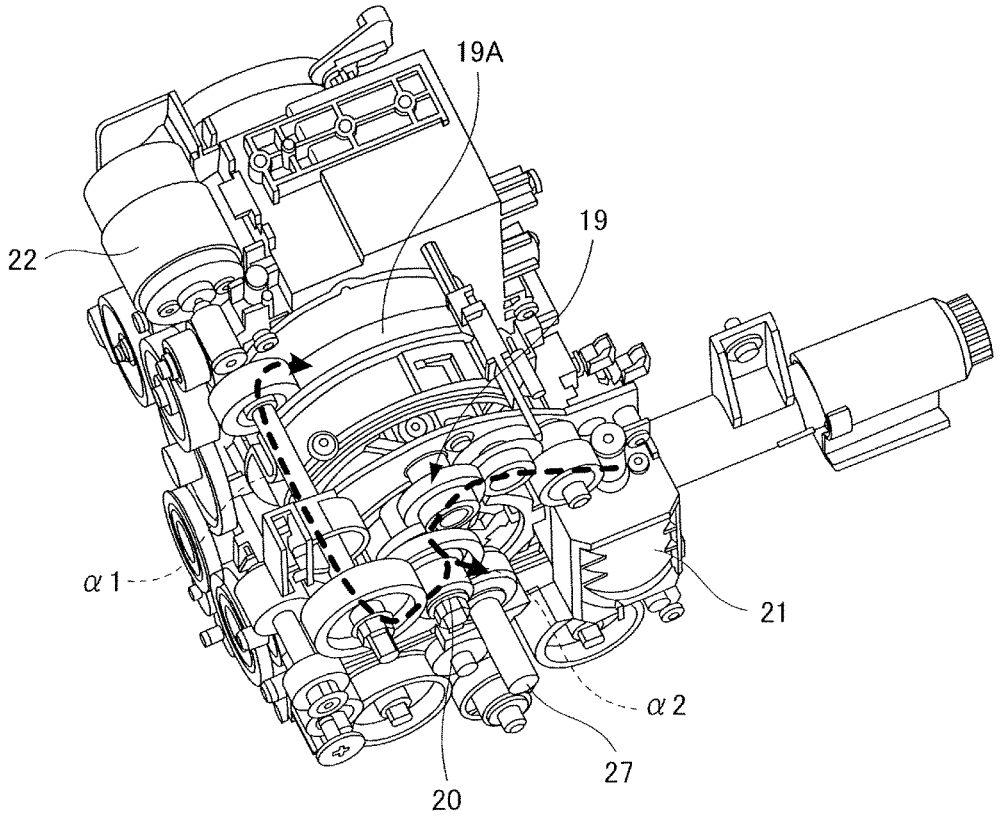
FIG. 4 is a perspective view of a hopper for description of a driving mechanism of the toner cartridge according to the first exemplary embodiment.
Figure 5:
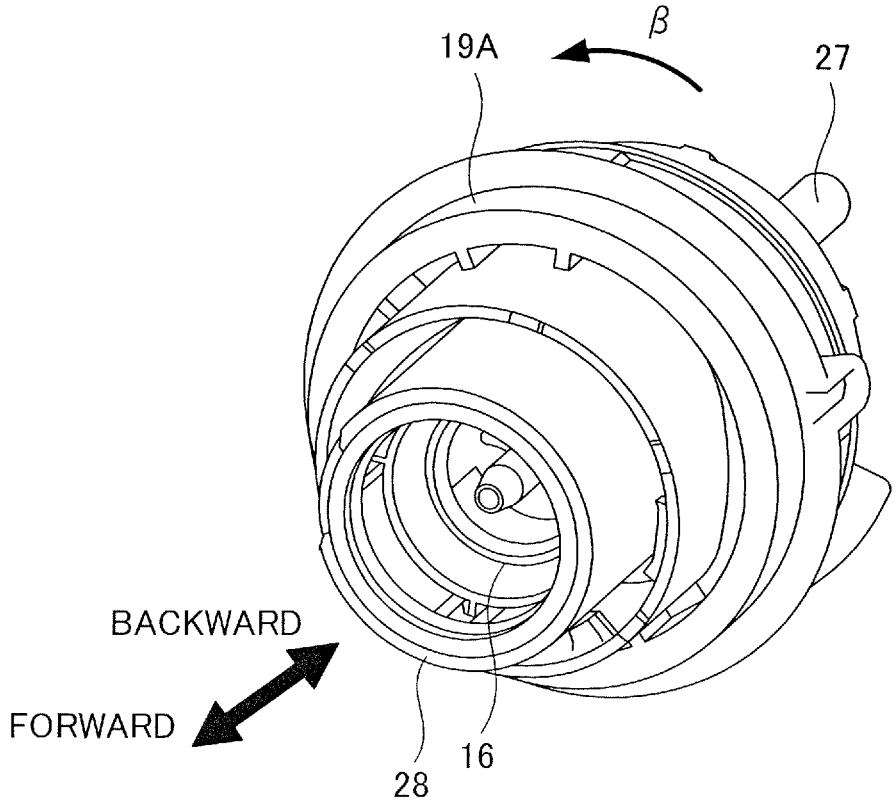
FIG. 5 is a perspective view of a supply port opening/closing mechanism according to the first exemplary embodiment.

As illustrated in FIG. 4, in the case where the motor 21 of the supply port opening/closing mechanism B is rotated in a normal rotation direction, a driving force is transmitted to the cam gear 19A via the drive transmission portion 19 constituted by a gear train or the like as indicated by an arrow $\alpha 1$. The cam gear 19A includes a gear on an outer peripheral surface and a cam surface on an inner peripheral surface as illustrated in FIG. 5, and a cylinder member 28 is disposed inside the cam gear 19A so as to be movable in the axial direction. The cam surface includes a groove, and the cylinder member 28 engages with the cam surface. In the case where the cam gear 19A is rotated in an arrow $\beta$ direction illustrated in FIG. 5 by the rotation of the motor 21 in the normal rotation direction, the cylinder member 28 moves forward in the axial direction due to the engagement with the cam surface of the cam gear 19A. That is, the cylinder member 28 moves toward the toner cartridge 14 along the axial direction.

At this time, the engagement member 16 moves in the axial direction together with the cylinder member 28, and thus the engagement member 16 engages with the cap 15 at the tip end of the toner cartridge 14. In the case where the cam gear 19A is further rotated in the arrow $\beta$ direction, the cylinder member 28 moves backward due to the engagement with the cam surface. That is, the cylinder member 28 moves away from the toner cartridge 14 along the axial direction. At this time, the engagement member 16 engaged with the cap 15 moves together with the cylinder member 28, and thus the cap 15 is pulled out and the supply port 14A of the toner cartridge 14 is opened as illustrated in FIG. 6.

Here, in the case where the motor 21 illustrated in FIG. 4 is rotated in a reverse rotation direction, the driving force is branched off by a one-way gear 20, and is transmitted to a cartridge driving shaft 27 as indicated by an arrow $\alpha 2$. The cartridge driving shaft 27 is connected to the engagement member 16 in an integrated manner, and thus the engagement member 16 is rotated by the rotation of the cartridge driving shaft 27 and the cap 15 engaged with the engagement member 16 is also rotated. The cap 15 is movable in the axial direction with respect to the toner cartridge 14, and is capable of rotating together with the toner cartridge 14. Accordingly, the toner cartridge 14 is also rotated by the rotation of the cap 15.

Figure 7:
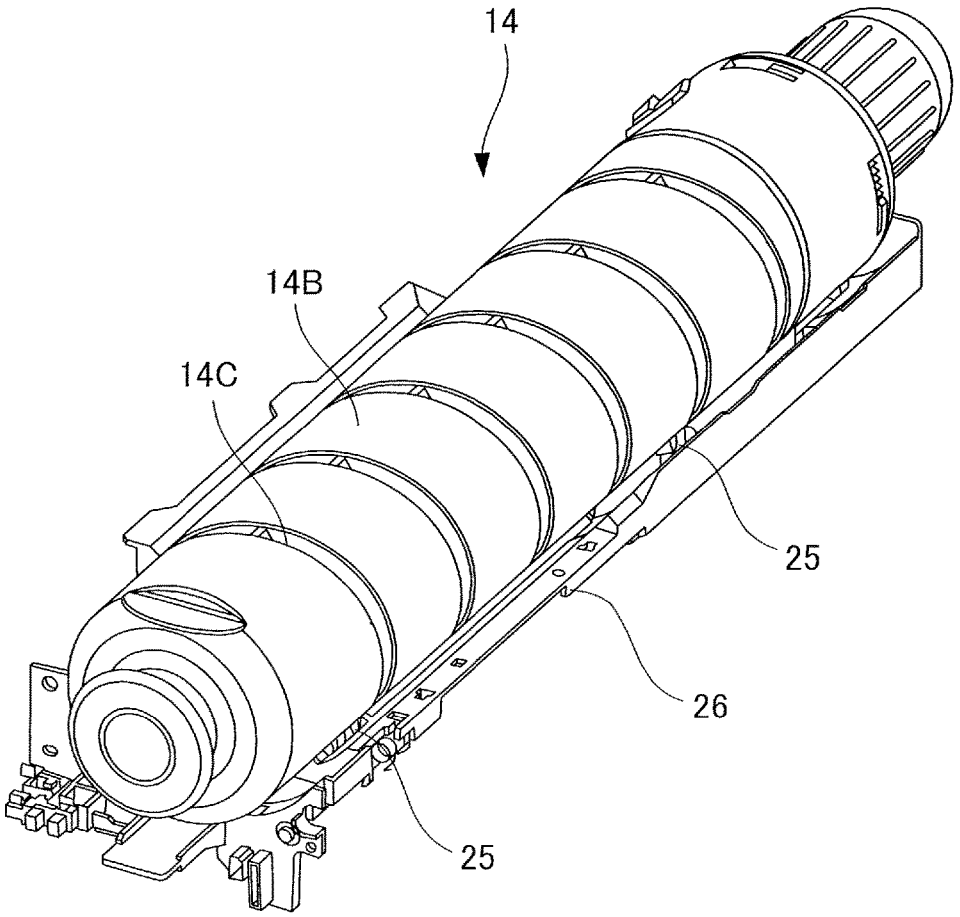
FIG. 7 is a perspective view of the toner cartridge according to the first exemplary embodiment attached to an apparatus body.
Figure 8:
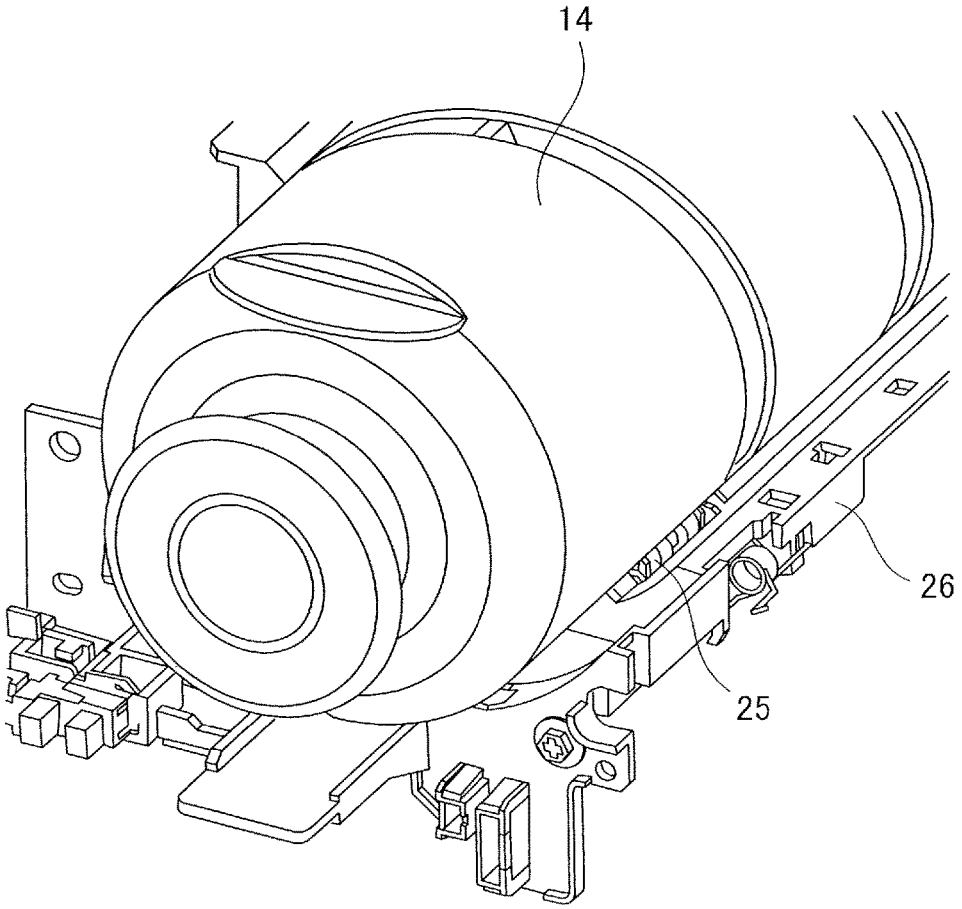
FIG. 8 is an enlarged perspective view of a configuration in which the toner cartridge according to the first exemplary embodiment is rotatably supported.

The toner cartridge 14 has a bottle shape in which a spiral groove 14C is defined in a cartridge body 14B as illustrated in FIG. 7. In addition, as illustrated in FIG. 2, a scooping member 14D is provided in the cartridge body 14B at a position in the vicinity of an exit port of the cartridge body 14B. Further, as illustrated in FIGS. 7 and 8, the toner cartridge 14 is disposed on a tray 26 so as to be rotatable with rollers 25 interposed therebetween. The tray 26 is provided at a predetermined position in the apparatus body 60A. Therefore, the rotation of the toner cartridge 14 is smoothened by the rollers 25.

In the case where the toner cartridge 14 rotates as indicated by arrows in FIG. 6, toner accommodated in the toner cartridge 14 is conveyed along the groove 14C to a portion in the vicinity of the exit port of the cartridge body 14B, and is scooped by the scooping member 14D to be conveyed to the supply port 14A. Then, toner is discharged through the supply port 14A. Since the supply port 14A has gotten in the hopper 201, toner discharged through the supply port 14A drops into the container 202, and is stored in the toner storage portion 18. In this way, in the case where the toner cartridge 14 rotates, toner is conveyed as an effect of the spiral groove 14C, and is supplied from the toner cartridge 14 to the container 202 of the hopper 201. In the present exemplary embodiment, the toner cartridge 14 corresponds to a developer supplying container, and the motor 21 corresponds to a supply driving portion.

Figure 9:
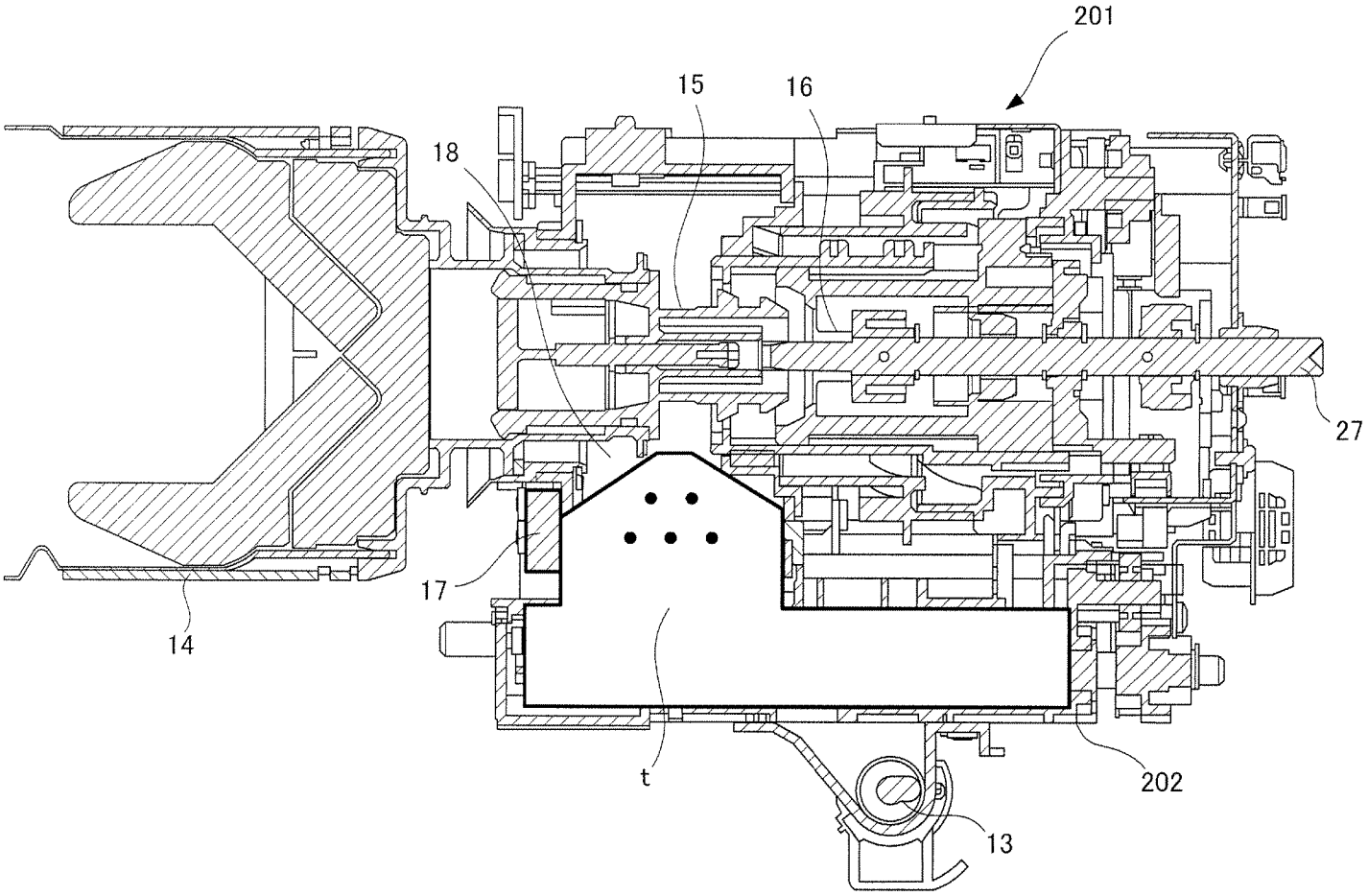
FIG. 9 is a section view of the hopper in a state in which toner is detected by a toner detection sensor.
Figure 10:
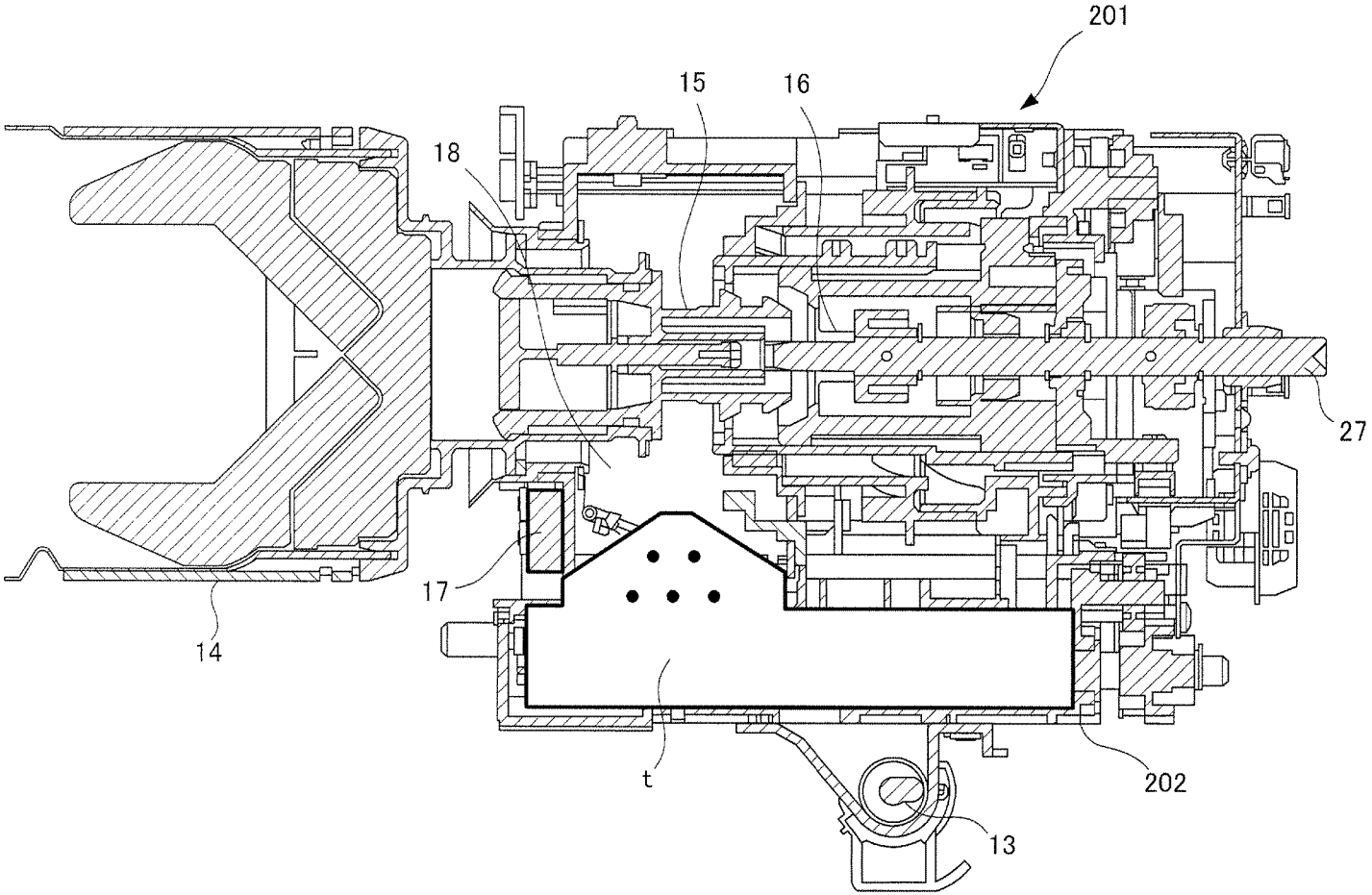
FIG. 10 is a section view of the hopper in a state in which toner is not detected by the toner detection sensor.

As illustrated in FIGS. 9 and 10, a toner sensor 17 serving as a developer detection portion configured to detect developer in the container 202 is provided at a predetermined height in the toner storage portion 18. The toner sensor 17 is a pressure sensor and detects the pressure of toner t in the case where the toner t is present on the surface of the toner sensor 17 as illustrated in FIG. 9. Thus, the control portion 100 recognizes that toner is present in the container 202.

In contrast, in the case where the toner in the toner storage portion 18 is consumed by supplying toner from the hopper 201 to the developing unit 613Y, the toner t becomes no longer present on the surface of the toner sensor 17 as illustrated in FIG. 10. In this case, the control portion 100 recognizes that toner is not present in the container 202, and toner is supplied from the toner cartridge 14 to the hopper 201 as will be described later. That is, the control portion 100 performs a supply operation of toner by rotating the toner cartridge 14 in the case where toner is not detected by the toner sensor 17.

The toner sensor 17 may be configured as a sensor that is not a pressure sensor as long as the toner sensor 17 is capable of detecting the presence of toner. For example, the toner sensor 17 may be an optical sensor that includes a light emitting portion and a light receiving portion configured to receive light emitted by the light emitting portion and detects the presence of toner between the light emitting portion and the light receiving portion.

Next, a configuration of supplying toner from the hopper 201 to the developing unit 613Y will be described. The hopper 201 includes the container 202, the agitating conveyance portion 203, a motor 22, and the drive transmission portion 23. The motor 22 serves as a drive source and an agitating driving portion. The agitating conveyance portion 203 includes the agitating screws 11, the first screw 12, and the second screw 13 each disposed in the container 202 as described above. The agitating screws 11 serve as agitating members, and the second screw 13 serves as a conveyance member.

Figure 11:
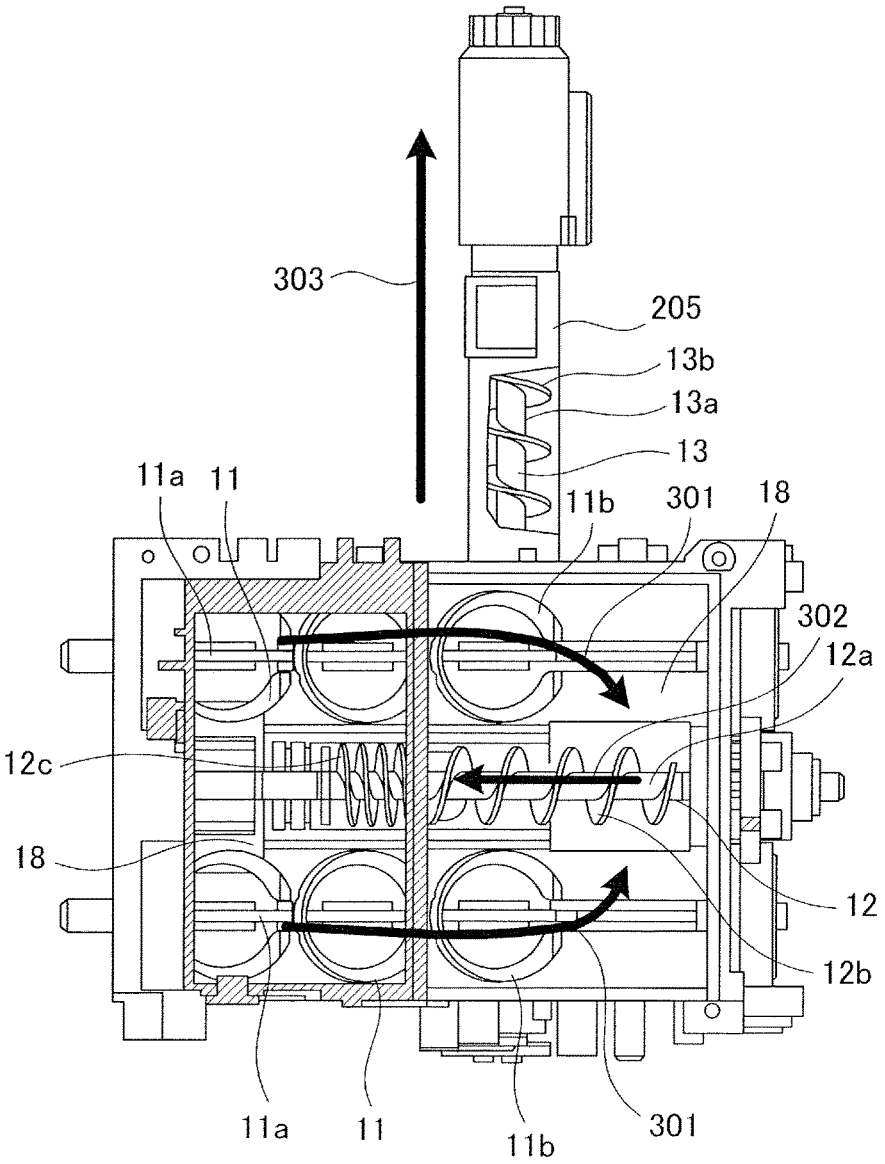
FIG. 11 illustrates the hopper according to the first exemplary embodiment viewed from above in a state in which a part of the hopper is cut off.

As illustrated in FIG. 11, two agitating screws 11 are arranged parallel so as to be capable of agitating toner in the toner storage portion 18. The agitating screws 11 are each constituted by a rotation shaft 11*a* and an agitating portion 11*b* provided around the rotation shaft 11*a*. The agitating portion 11*b* has a substantially elliptical shape that is hollow inside. According to this, toner smoothly flows in arrow 301 directions while being agitated by the rotation of the agitating screws 11. As described above, the agitating screws 11 are configured to be mainly capable of agitating toner such that clogging with toner does not occur from excess conveyance of toner by the agitating screws 11.

Figure 12B:
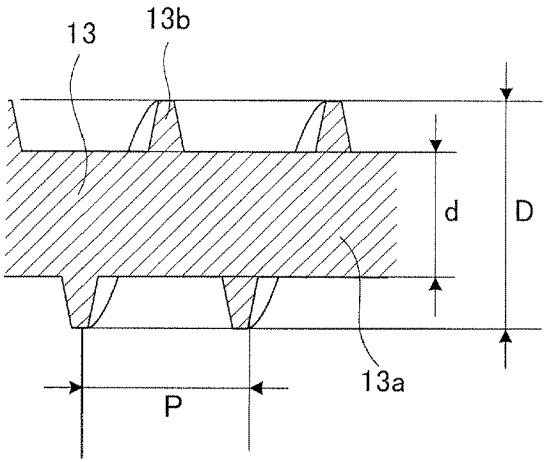
FIG. 12B is an enlarged section view of a part of a second screw.
Figure 12A:
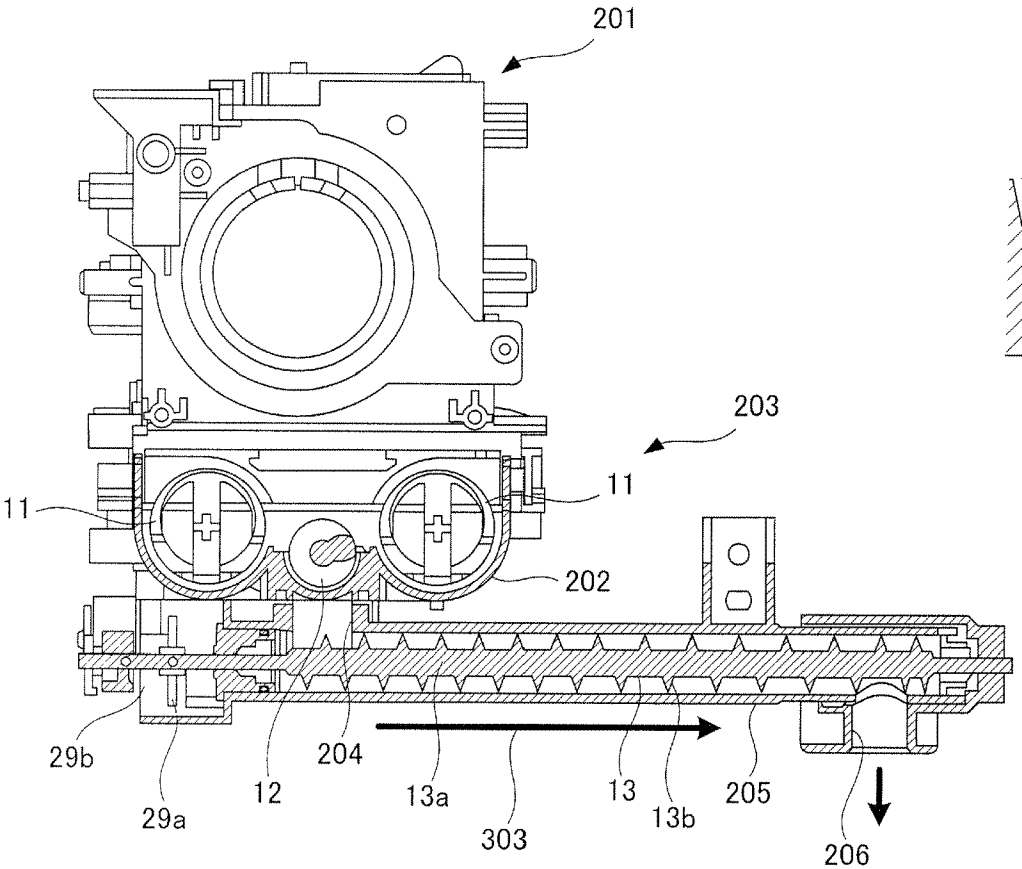
FIG. 12A illustrates the hopper according to the first exemplary embodiment viewed from the side in a state in which a part of the hopper is cut off.

Meanwhile, the first screw 12 is disposed parallel to the two agitating screws 11 between the agitating screws 11 as illustrated in FIGS. 11 and 12A. The first screw 12 is constituted by a rotation shaft 12*a* and blades 12*b* and 12*c* provided in a spiral shape around the rotation shaft 12*a*. The blades 12*b* and 12*c* are formed in opposite directions to each other around the rotation shaft 12*a*, and each convey toner in a direction to approach the other of the blades 12*b* and 12*c* as a result of the rotation shaft 12*a* rotating in a predetermined direction. The toner conveyed by the agitating screws 11 in the arrow 301 directions illustrated in FIG. 11 is conveyed in an arrow 302 direction by the first screw 12 between the two agitating screws 11.

A communication port 204 is defined below a substantially center portion of the first screw 12 as illustrated in FIGS. 2 and 12A. The toner conveyed in the arrow 302 direction by the first screw 12 drops downward through the communication port 204. At this time, the toner conveyed in the arrow 302 direction by the blade 12*b* is pushed back by the blade 12*c*, and thus drops in the communication port 204 efficiently.

A discharge path 205, which is a part of the container 202, is formed below the communication port 204. The discharge path 205 is formed in a direction substantially perpendicular to the agitating screws 11 and the first screw 12. In addition, the second screw 13 is disposed in the discharge path 205 along the discharge path 205.

As illustrated in FIGS. 11 and 12A, the second screw 13 is constituted by a rotation shaft 13*a* and a blade 13*b* provided in a spiral shape around the rotation shaft 13*a*, and conveys tonner having dropped into the discharge path 205 in an arrow 303 direction. The discharge port 206 that is an opening facing downward is provided at a downstream end portion of the discharge path 205 in the conveyance direction of toner. Accordingly, the second screw 13 conveys the toner in the container 202 to the discharge port 206. The discharge port 206 communicates with the developing unit 613Y, and the toner discharged through the discharge port 206 is supplied to the developing unit 613Y.

Figure 13:
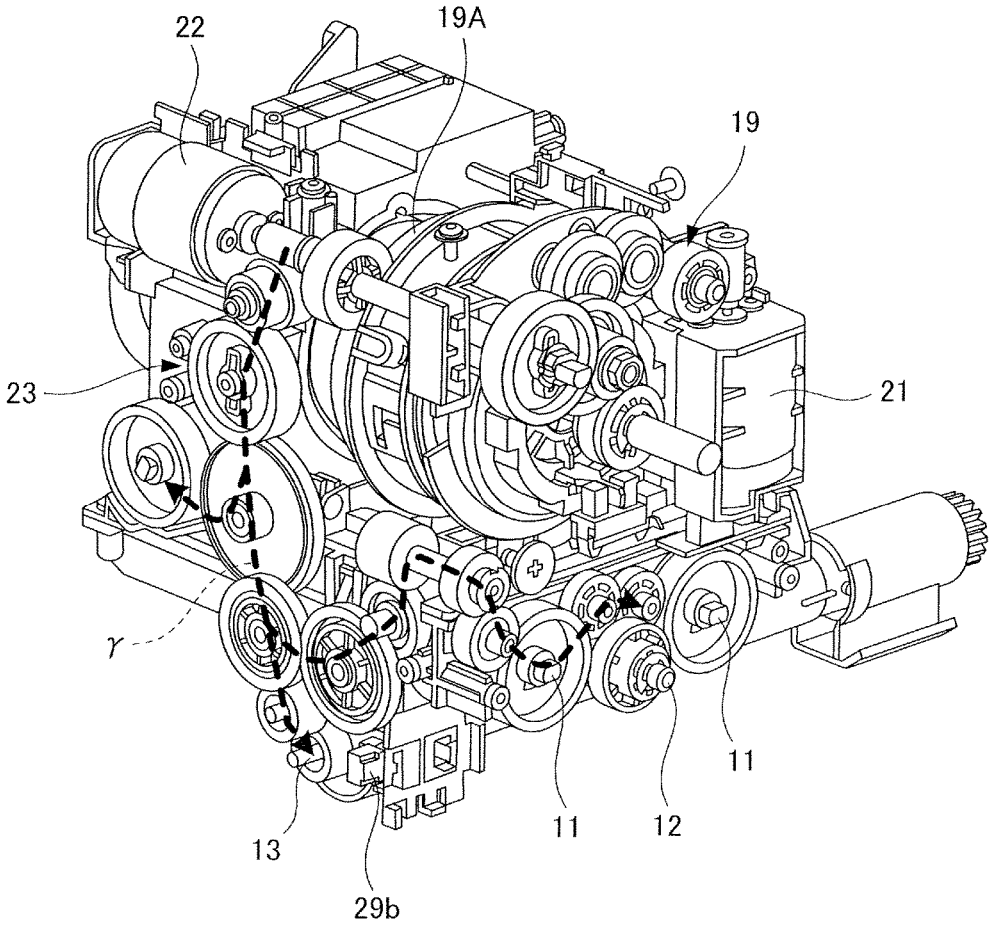
FIG. 13 is a perspective view of the hopper for description of a driving mechanism related to toner supply according to the first exemplary embodiment.

The agitating screws 11, the first screw 12, and the second screw 13 having these configurations are rotated by the motor 22 via the drive transmission portion 23 as illustrated in FIG. 13. Specifically, in the case where the control portion 100 receives a signal indicating shortage of toner from the inductance sensor 620 in the developing unit 613Y, the motor 22 is driven such that an appropriate amount of toner is supplied to the developing unit 613Y.

The driving force of the motor 22 is transmitted to each of the rotation shafts of the agitating screws 11, the first screw 12, and the second screw 13 via the drive transmission portion 23, which is constituted by a gear train or the like, as indicated by arrows γ in FIG. 13. According to this, each screw rotates as described above, and toner is supplied from the hopper 201 to the developing unit 613Y. In the present exemplary embodiment, each screw is driven by rotating a single motor 22 in a predetermined direction as described above, and thus the costs for the developer supplying device 200Y can be cut.

In addition, as illustrated in FIG. 12A, a sensor flag 29*a* is provided at an end portion of the rotation shaft 13*a* of the second screw 13. The rotational phase of the second screw 13 can be detected by detecting the sensor flag 29*a* by a rotation sensor 29*b*. In the present exemplary embodiment, the control portion 100 detects the rotation of the second screw 13 on the basis of a detection signal of the rotation sensor 29*b*. An appropriate amount of toner can be supplied from the hopper 201 to the developing unit 613Y by rotating the second screw 13 a set number of times.

Specifically, the second screw 13 is controlled to rotate once in one supply operation. The weight Q of toner conveyed, that is, the amount of toner supplied to the developing unit 613Y, by one rotation of the second screw 13 can be obtained as follows. That is, in the case where P represents a screw pitch, D represents an outer diameter of the screw, and d represents a shaft diameter of the screw as illustrated in FIG. 12B, and μ represents a filling efficiency and γ represents a bulk density of toner in the discharge path 205, the amount Q of toner supply can be obtained by the following equation. In this case, the outer diameter of the screw corresponds to the outer diameter of the blade 13*b*, and the shaft diameter of the screw corresponds to the diameter of the rotation shaft 13*a*.

$$Q = \frac{\pi}{4}(D^2 - d^2) * \mu P * \gamma$$

Control Portion

Figure 14:
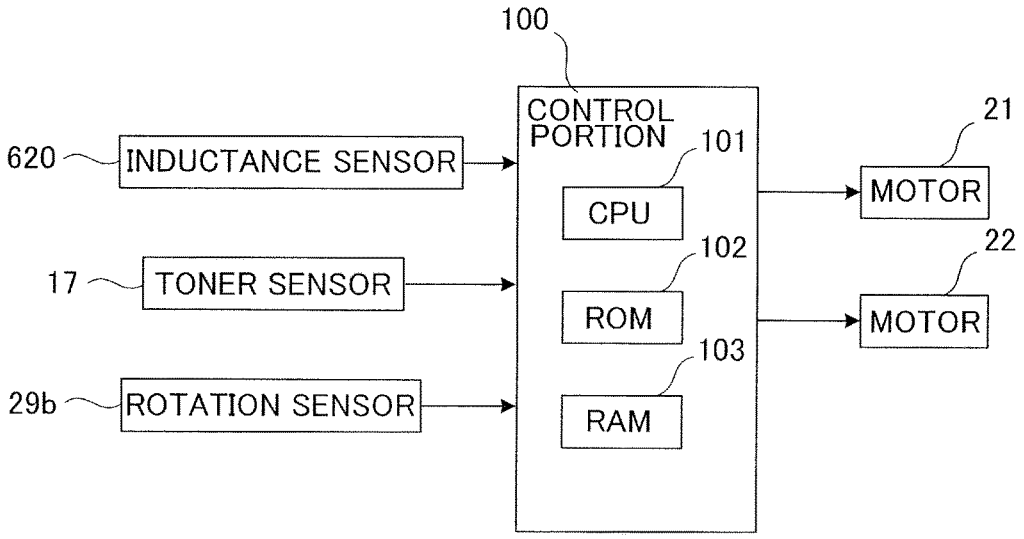
FIG. 14 is a control block diagram of the developer supplying device according to the first exemplary embodiment.

Here, relationships between the control portion 100 that performs control as described above and the motors and sensors will be described with reference to FIG. 14. The control portion 100 includes a central processing unit: CPU 101, a read-only memory: and ROM 102, a random access memory: RAM 103. The ROM 102 stores programs corresponding to control procedures and so forth. The CPU 101 is configured to read out the programs and control each component. In addition, RAM 102 stores data for work and input data. The CPU 101 is configured to perform control by referring to the data stored in the RAM 102 on the basis of the programs and so forth described above.

The operations of the motors 21 and 22 and output of the respective sensors 620, 17, and 29*b* described above are controlled by the CPU 101 of the control portion 100. That is, the CPU 101 controls the operations of the motors 21 and 22 as described above on the basis of output signals from the respective sensors 620, 17, and 29*b* while referring to the ROM 102 and the RAM 103.

Detection of Toner in Hopper

As described above, the toner sensor 17 detects the presence of toner in the hopper 201. However, it is known that properties of toner change in accordance with the environment and that particularly the fluidity thereof decreases in a high-temperature and high-humidity environment. In addition, the fluidity also decreases due to the deterioration of the toner. The effect of decrease in the fluidity will be described with reference to FIG. 15. In the case where the fluidity decreases, a powder surface of the toner in the container 202 of the hopper 201 does not spread in the horizontal direction, and the heap of toner becomes higher in the vertical direction. Here, an angle indicated by θ in FIG. 15 will be referred to as an angle of repose of toner.

In the case where the angle of repose of toner increases, toner does not come into contact with the toner sensor 17 even though a sufficient amount of toner is in the container 202. The toner cartridge 14 is driven in accordance with the detection of toner by the toner sensor 17 to supply toner to the hopper 201 as described above. Therefore, in the case where the toner cartridge 14 is driven in a state in which the toner is in a shape of a heap, the toner eventually reaches the supply port 14A of the toner cartridge 14. In the case where an inclined surface of the heap of toner is not in contact with the toner sensor 17 and the output of the toner sensor 17 does not indicate the presence of toner even in this state, the toner cartridge 14 is kept driven. However, in the state where the supply port 14A is clogged, toner is not likely to be further discharged no matter how long the toner cartridge 14 is driven.

Here, in the case where the toner sensor 17 does not detect toner even after driving the toner cartridge 14 for a predetermined period of time, the CPU 101 of the control portion 100 determines that toner is not present in the toner cartridge 14. Then, for example, a screen indicating that the toner cartridge 14 needs to be replaced is displayed on a display portion provided for the image forming apparatus 60.

Accordingly, in the case where the toner in the container 202 of the hopper 201 is in a shape of a heap as described above, toner is sometimes not detected by the toner sensor 17 even after driving the toner cartridge 14 for the predetermined period of time. Moreover, there is a possibility that the control portion 100 erroneously determines that toner is not present in the toner cartridge 14 even in the case where toner is present in the toner cartridge 14. In addition, in the case where the toner cartridge 14 is kept rotating until determination of replacement in a state in which toner is in contact with the toner cartridge 14 in the vicinity of the supply port 14*a*, the toner deteriorates due to friction. Therefore, in the present exemplary embodiment, the following toner supply sequence is performed.

Toner Supply Sequence

A toner supply sequence performed at the time of supplying toner from the toner cartridge 14 into the hopper 201 will be described. In the case where the CPU 101 determines that toner is not present on the basis of a detection signal from the toner sensor 17 provided in the container 202 of the hopper 201, the CPU 101 outputs a command to drive the toner cartridge 14 in accordance with a flowchart of FIG. 17 that will be described later.

In the present exemplary embodiment, the toner supply sequence is set in three stages 1 to 3 in accordance with the amount of remaining toner in the toner cartridge 14. The stage 1 is performed at a time immediately after replacement of the toner cartridge 14 at which plenty of new toner is in the toner cartridge 14. The stage 2 is performed when the amount of remaining toner in the toner cartridge 14 is about 20% to 80% of a filled-up state. The stage 3 is performed when the amount of remaining toner in the toner cartridge 14 is less than 20% of the filled-up state.

Figure 16:
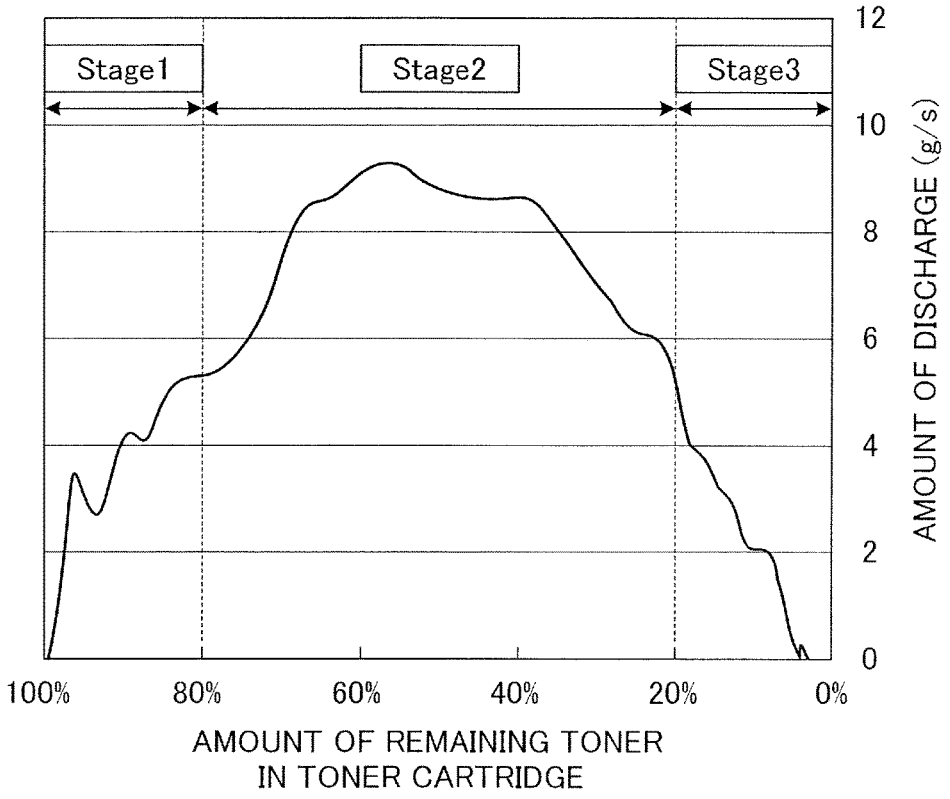
FIG. 16 illustrates a relationship between amounts of toner remaining in and amounts of toner discharged from the toner cartridge according to the first exemplary embodiment.

The reason why the respective stages are set in accordance with the amount of remaining toner in the toner cartridge 14 as described above is because the amount of toner discharged from the toner cartridge 14, that is, a supply property of the toner cartridge 14, is not always constant. FIG. 16 illustrates a relationship between amounts of remaining toner in the toner cartridge 14 and amounts of discharge from the toner cartridge 14 per unit time. To be noted, the driving speed of the toner cartridge 14 is the same in all the stages. In addition, the weight of toner in the case where the toner cartridge 14 is filled up with toner is set as 100%.

First, the amount of discharged toner per unit time when the amount of remaining toner is 80% to 100%, that is, 80% or larger and 100% or smaller, is equal to or smaller than 1 g/s. In addition, although the amount of discharge overall has a tendency to increase as the discharge of toner progresses, that is, as the amount of remaining toner in the toner cartridge 14 decreases, the amount of discharged toner also slightly decreases in a part of the whole process. This is because the density of toner becomes uneven in the toner cartridge 14 due to the inclination of the toner cartridge 14 at which the toner cartridge 14 is stored and vibrations applied to the toner cartridge 14 during transportation. However, this unevenness of toner density is temporary, and is cancelled after the toner cartridge 14 is driven and rotated.

Next, when the amount of remaining toner is 50% to 80%, that is, 50% or larger and smaller than 80%, the unevenness of toner in the toner cartridge 14 is cancelled, and the amount of discharged toner stably increases. In addition, when the amount of remaining toner is 20% to 50%, that is, 20% or larger and smaller than 50%, the amount of discharged toner gradually decreases along with decrease of the amount of toner in the toner cartridge 14.

Further, when the amount of remaining toner is 0% to 20%, that is, 0% or larger and smaller than 20%, the amount of discharged toner steeply decreases because it becomes difficult for the scooping member 14D illustrated in FIG. 2 to scoop toner due to further decrease of the amount of toner in the toner cartridge 14.

In consideration of such a toner discharge property, the stage corresponding to the amount of remaining toner in the toner cartridge 14 of 80% to 100% is set as the stage 1, the stage corresponding to the amount of remaining toner of 20% to 80% is set as the stage 2, and the stage corresponding to the amount of remaining toner 0% to 20% is set as the stage 3. In addition, the range of amount of remaining toner from 20% to 80%, that is, 20% or larger and smaller than 80%, corresponding to the stage 2 is set as a first range, the range of amount of remaining toner from 0% to 20%, that is, 0% or larger and smaller than 20%, corresponding to the stage 3, which corresponds to a smaller amount of remaining toner than the first range, is set as a second range. Meanwhile, the range of amount of remaining toner from 80% to 100%, that is, 80% or larger and 100% or smaller, corresponding to the stage 1, which corresponds to a larger amount of remaining toner than the first range, is set as a third range.

Detection of Amount of Remaining Toner in Toner Cartridge

Next, a configuration of detecting the amount of remaining toner in the toner cartridge 14 will be described. The control portion 100 calculates the amount of remaining developer in the toner cartridge 14 from the driving amount of the agitating conveyance portion 203. That is, the control portion 100 detects the amount of remaining developer in the toner cartridge 14 by calculation. Detailed description will be given below.

In the case where the CPU 101 of the control portion 100 receives a signal indicating shortage of toner from the inductance sensor 620 of the developing unit 613Y, the CPU 101 drives the motor 22 to rotate the second screw 13 of the agitating conveyance portion 203. At this time, the CPU 101 counts the number of rotations of the second screw 13 on the basis of a signal from the rotation sensor 29*b*. That is, the CPU 101 can detect the number of rotations serving as a driving amount of the second screw 13 as a result of the rotation sensor 29*b* detecting the sensor flag 29*a* provided on the rotation shaft 13*a* of the second screw 13. An integrated value of the number of rotations of the second screw 13 is stored in a memory such as the RAM 103.

Here, toner in the toner cartridge 14 is temporarily supplied to the hopper 201, and is then conveyed to the developing unit 613Y by the first screw 12 and the second screw 13. As described above, the amount of conveyance by one supply operation, that is, one rotation, of the second screw 13 is determined in advance. In addition, in the case where the amount of toner in the hopper 201 decreases and the toner sensor 17 indicates absence of toner, the control portion 100 drives the motor 21 to rotate the toner cartridge 14, and thus toner is supplied from the toner cartridge 14 to the hopper 201.

Therefore, the amount of consumption of the toner in the toner cartridge 14 that has been consumed can be obtained by counting the number of times the supply operation to the developing unit 613Y has been performed, that is, the number of times the second screw 13 has been rotated, after the toner cartridge 14 has been replaced by a new toner cartridge. Specifically, the amount of consumption of the toner in the toner cartridge 14 can be calculated by multiplying the number of supply operations by the amount of conveyed toner for one supply operation represented by the weight Q of toner. In the present exemplary embodiment, the amount of toner with which the toner cartridge 14 is filled is 1000 g, and the amount of conveyed toner per rotation of the second screw 13 is 0.3 g. Accordingly, each time one supply operation to the developing unit 613Y is performed, the amount of remaining toner in the toner cartridge 14 decreases by 0.3/1000 =0.03%.

As described above, in the present exemplary embodiment, the CPU 101 counts the number of times the supply operation to the developing unit 613 has been performed, and calculates the amount of remaining toner in the toner cartridge 14 from the value of the count, that is, the driving amount of the agitating conveyance portion 203. Then, to which of the stages 1 to 3 the amount of remaining toner in the toner cartridge 14 corresponds is determined, and the following control is performed.

Supply Control of Toner

In the present exemplary embodiment, the control portion 100 performs the supply operation of toner by the toner cartridge 14 in the case where toner is not detected by the toner sensor 17 in the hopper 201, that is, in a sensor off state. As described above, the supply operation of toner is performed by conveying the toner in the toner cartridge 14 by the spiral groove 14C defined in the toner cartridge 14 by driving the motor 21 to rotate the toner cartridge 14. Therefore, the driving amount or the number of times of driving of the toner cartridge 14 that will be used in the description below corresponds to the driving amount or the number of times of driving of the motor 21 serving as a supply driving portion. In addition, the control portion 100 controls the motors 21 and 22 such that, in the supply operation, each time the second screw 13 of the agitating conveyance portion 203 is driven by a first driving amount, the toner cartridge 14 is driven by a second driving amount. Further, the control portion 100 sets the first driving amount to a different value on the basis of the amount of remaining toner in the toner cartridge 14 calculated by the CPU 101 as described above and serving as a detection result. In the present exemplary embodiment, different values of the first driving amount are set for the stages 1 to 3 described above, and the second driving amount is set to "1" regardless of the stage.

A flow of toner supply control by the developer supplying device 200Y of the present exemplary embodiment having such a configuration common to the stages 1 to 3 will be described with reference to FIG. 17. First, in step S1, counts T and N of the number of times of driving of the toner cartridge 14 is set to 0 for preparation for driving of the toner cartridge 14.

Here the count T represents the number of times of driving of the toner cartridge 14 in the supply operation from the toner cartridge 14 to the hopper 201 and corresponds to the second driving amount described above, which is 1 in the present exemplary embodiment. In addition, the count N is a threshold value used for emptiness determination in which it is determined that the toner cartridge 14 is empty, and is set to 50 in the present exemplary embodiment. This count of times of driving of the toner cartridge 14 is performed by the control portion 100.

Next, after a state in which toner has been supplied from the hopper 201 to the developing unit 613Y and the toner is not detected by the toner sensor 17, that is, an off state, is taken in step S2, the control portion 100 outputs a command to drive the motor 21, and the toner cartridge 14 starts to be driven. At this time, the toner cartridge 14 keeps on being driven for four seconds in step S3, and then stops for one second in step S4. The driving and stopping of the toner cartridge 14 in steps S3 and S4 will be defined as one cycle.

After one cycle of the driving and stopping of the toner cartridge 14 finishes, the counts T and N of times of driving of the toner cartridge 14 are increased by one, that is, T=T+1 and N=N+1 are performed in step S5. Next, the state of the toner sensor 17 is checked in step S6, and, in the case where the toner sensor 17 is in a state of detecting toner, that is, an on state, information indicating the state is transmitted to the control portion 100, the process returns to step S1, and the counts T and N of times of driving of the toner cartridge 14 are reset to 0. Then, the developer supplying device 200Y takes a stand-by state until the toner sensor 17 is in the off state again as a result of the supply operation from the hopper 201 to the developing unit 613Y.

In contrast, in the case where the toner sensor 17 is still in the off state in step S6, it is determined in step S7 whether the count T of times of driving of the toner cartridge 14 has reached the threshold value serving as the second driving amount. Since the threshold value is 1, the process proceeds to step S8 in this case. To be noted, the threshold value can be set as appropriate. For example, in the case where the threshold value is set to 2, the process returns to step S3, and the driving and stopping of the toner cartridge 14 is performed for one more cycle. In the case where the count T has reached the threshold value, it is determined in step S8 whether the count N has reached 50. This determination will be described later.

In the case where the count N is equal to or smaller than 50 in step S8, whether the supply operation from the hopper 201 to the developing unit 613Y has been performed a predetermined number of times M corresponding to the first driving amount is checked in step S9. That is, the CPU 101 determines whether the second screw 13 of the hopper 201 is driven M times while the toner cartridge 14 is driven for one cycle. The count of the supply operation to the developing unit 613Y is performed starting from step S3.

Here, the supply operation from the hopper 201 to the developing unit 613Y is performed on the basis of the result of detection by the inductance sensor 620. In the case where the CPU 101 determines, on the basis of the detection result, not to perform the supply operation, the number of times of the supply operation is of course not counted. In the case where the supply operation has not been performed M times, the process returns to step S6, and the developer supplying device 200Y takes a stand-by state for the supply operation of toner. In contrast, in the case where the supply operation has been performed M times, the process returns to step S3, and the toner cartridge 14 is driven.

This point will be described in further detail. The information from the inductance sensor 620 disposed in the developing unit 613Y is always transmitted to the control portion 100. The CPU 101 of the control portion 100 determines the state of the inductance sensor 620, and determines whether the supply operation is needed from the result of the determination. Then, in the case where it is determined that the supply operation is needed, a command to perform the supply operation is output, for the first time, to the motor 22 that drives the agitating conveyance portion 203. Therefore, by checking whether the command has been output, the control portion 100 counts the number of times of the supply operation from the hopper 201 to the developing unit 613Y and further checks whether the supply operation has been performed the predetermined number of times M.

In the case where the supply operation to the developing unit 613Y has been performed M or more times in step S3 or step S4 since the most recent start of driving of the toner cartridge 14, the process transitions to step S3, and the flow of the flowchart is sequentially performed in the same manner as the sequence of the first stage. In contrast, in the case where the number of times of the supply operation to the developing unit 613Y has not reached M, the process returns to step S6, and the toner cartridge 14 remains stopped. Accordingly, unless a detection state of the inductance sensor 620 does not indicate that the supply operation is needed, the command to perform the supply operation to the developing unit 613Y is not output, and the driving of the toner cartridge 14 remains stopped.

As described above, in the present exemplary embodiment, the process cannot transition to step S3 to start the second cycle of driving and stopping of the toner cartridge 14 until the toner sensor 17 takes the off state, the toner cartridge 14 starts the first driving and stopping cycle, and the supply operation to the developing unit 613Y is performed M times. That is, the toner cartridge 14 is driven once, which corresponds to the second driving amount, each time the supply operation to the developing unit 613Y is performed M times, in other words, each time the second screw 13 is rotated a number of times corresponding to the first driving amount.

In the case where the supply operation to the developing unit 613Y is performed, the second screw 13 and the agitating screws 11 rotate along with the supply operation. In this case, the heap of toner formed in the container 202 of the hopper 201 is leveled to some extent, and the amount of toner in the container 202 decreases by an amount corresponding to the toner supplied to the developing unit 613Y. Therefore, even in the case where the heap of toner is so high as to reach the supply port 14*a* of the toner cartridge 14, the height of the heap is reduced.

Here, as described above with reference to FIG. 16, the amount of discharged toner per unit time varies depending on the amount of remaining toner in the toner cartridge 14. That is, the supplying property in a case where the toner is supplied from the toner cartridge 14 to the container 202 of the hopper 201 according to the driving of the toner cartridge 14 varies. Therefore, in the case where the first driving amount described above is set to a uniform value regardless of the amount of remaining toner in the toner cartridge 14, there is a possibility that the heap of toner in the container 202 cannot be sufficiently leveled or the height of the heap cannot be sufficiently reduced.

Figure 15:
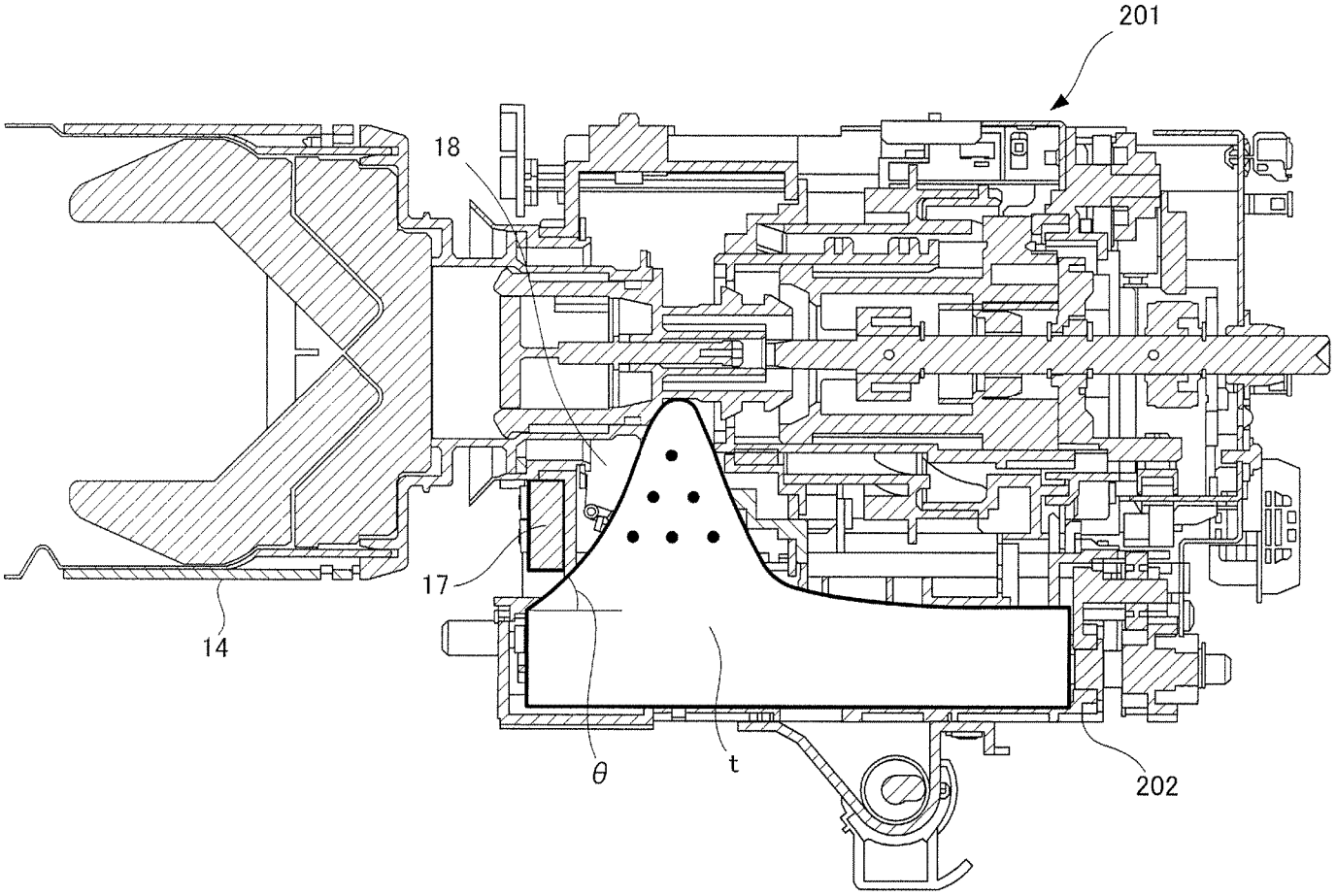
FIG. 15 is a section view of the hopper illustrating a state in which developer in the hopper reaches a supply port of the toner cartridge.

For example, in the case where the amount of discharged toner per unit time is large and the supply operation is performed once each time the toner cartridge 14 is driven for one cycle, next supply from the toner cartridge 14 is performed before the heap of toner is sufficiently leveled or the height of the heap is sufficiently reduced. In the case where the heap of toner is not sufficiently leveled, the toner is not detected by the toner sensor 17 as illustrated in FIG. 15, and toner is further supplied from the toner cartridge 14. In addition, in the case where toner is supplied again from the toner cartridge 14 without the height of the heap of toner being sufficiently reduced, the heap of toner comes into contact with the toner cartridge 14 in the vicinity of the supply port 14*a*, and the toner deteriorates due to the friction.

In contrast, in the case where the amount of discharged toner per unit time is small and the supply operation is performed, for example, five times each time the toner cartridge 14 is driven for one cycle, there is a possibility that the supply of toner from the toner cartridge 14 to the hopper 201 does not keep up with the supply of toner from the hopper 201 to the developing unit 613Y. In addition, in the case where the supply operation is performed more times, the period of time in which the toner is agitated by the rotation of the agitating screws 11 also becomes longer, and thus the deterioration of toner is accelerated. Therefore, in the present exemplary embodiment, different values of the first driving amount are set for the stages 1 to 3 described above. That is, different values of the first driving amount are set in accordance with the supplying property, or, the discharge property, of the toner from the toner cartridge 14, and, in the present exemplary embodiment, the supplying property is defined by the amount of remaining toner in the toner cartridge 14.

Stage 2

First, in the stage 2, the amount of remaining toner is in the range of 20% to 80%, that is, 20% or larger and smaller than 80%, serving as the first range. In this case, the predetermined number of times M serving as the first driving amount is set to 5 serving as a first amount. That is, in the stage 2, the toner cartridge 14 is driven once, that is, for one cycle, each time the supply operation to the developing unit 613Y is performed five times, that is, each time the second screw 13 is rotated five times.

As illustrated in FIG. 16, the amount of discharged toner per unit time is large in the stage 2. Therefore, a large amount of toner is supplied to the container 202 of the hopper 201 by driving the toner cartridge 14 for one cycle, and thus the height of the heap of toner in the container 202 is likely to be large. Thus, in the present exemplary embodiment, the supply operation from the hopper 201 to the developing unit 613Y is performed five times each time the toner cartridge 14 is driven for one cycle. Further, the agitating screws 11 are used for sufficiently leveling the heap of toner, and the height of the heap is reduced by supplying toner to the developing unit 613Y.

As described above, by agitating the toner in the container 202 along with the supply operation to the developing unit 613Y, the heap of toner in the container 202 can be efficiently leveled. As a way of leveling the heap of toner, also agitating the toner in the hopper 201 in a period in which the supply operation is not performed can be considered. However, the deterioration of toner is accelerated in this case.

In contrast, in the present exemplary embodiment, the toner in the container 202 is agitated only during the supply operation, and thus the acceleration of deterioration of toner can be suppressed. In addition, since the threshold value is reset in the case where it is determined by the toner sensor 17 that toner is present, it becomes possible to keep on efficiently discharging toner from the toner cartridge 14.

Stage 3

Next, in the stage 3, the amount of remaining toner is in the range of 0% to 20%, that is, 0% or larger and smaller than 20%, serving as the second range, which corresponds to a smaller amount than the first range. In this case, the predetermined number of times M serving as the first driving amount is set to 1 serving as a second amount, which is smaller than 5 serving as the first amount. That is, in the stage 3, the toner cartridge 14 is driven once, that is, for one cycle, each time the supply operation to the developing unit 613Y is performed once, that is, each time the second screw 13 is rotated once.

As illustrated in FIG. 16, the amount of discharged toner per unit time steeply decreases in the stage 3. Accordingly, the amount of toner supplied to the container 202 of the hopper 201 by driving the toner cartridge 14 for one cycle is small. Meanwhile, the state of the toner sensor 17 in the container 202 does not change from the off state to the on state unless the amount of toner supplied from the toner cartridge 14 to the hopper 201 surpasses the amount of toner supplied from the hopper 201 to the developing unit 613Y. Therefore, in the present exemplary embodiment, the supply operation from the hopper 201 to the developing unit 613Y is performed once each time the toner cartridge 14 is driven for one cycle. Further, the amount of toner supplied from the toner cartridge 14 to the hopper 201 is set so as to surpass the amount of toner supplied from the hopper 201 to the developing unit 613Y.

Stage 1

Next, in the stage 1, the amount of remaining toner is in the range of 80% to 100%, that is, 80% or larger and 100% or smaller, serving as the third range, which corresponds to a larger amount than the first range. In this case, the predetermined number of times M serving as the first driving amount is set to 0. That is, in the stage 1, the toner cartridge 14 is driven until the toner sensor 17 takes the on state regardless of the supply operation to the developing unit 613Y.

As illustrated in FIG. 16, the toner discharge property of the toner cartridge 14 is not stable in the stage 1. In addition, the image forming apparatus 60 is not operating and toner is not present in the developing unit 613Y immediately after replacement of the toner cartridge 14. Therefore, the supply operation from the hopper 201 to the developing unit 613Y is not performed until the toner sensor 17 in the container 202 of the hopper 201 takes the on state. Thus, in the present exemplary embodiment, the predetermined number of times M is set to 0, and the toner cartridge 14 is driven without waiting for the supply operation to the developing unit 613Y.

The determination of emptiness of the toner cartridge 14 performed in step S8 will be described herein. In the case where the toner sensor 17 is in the off state in step S6 and the process proceeds to step S8, it is determined whether the count N of times of driving of the toner cartridge 14 exceeds 50. In the case where the count N exceeds 50, the control portion 100 determines that supply of toner to the hopper 201 is not expected even if the toner cartridge 14 is driven further, and determines that the toner cartridge 14 is empty in step S10.

Here, it is determined that the toner cartridge 14 is empty in the stage 3 in which the amount of remaining toner in the toner cartridge 14 is small. Thus, in the case where the count N is equal to or smaller than 50 in step S8, the process proceeds to step S9, and it is determined whether the supply operation from the hopper 201 to the developing unit 613Y has been performed the predetermined number of times M, which is 1 in this case. In the case where such operations are performed and the count N exceeds 50 in step S8, it is determined that toner is not present in the toner cartridge 14. Therefore, in the present exemplary embodiment, it is determined that toner is not present after the agitation and supply operation are performed at least fifty times in the stage 3. Accordingly, there is a chance to cancel the state of the heap of toner in this process.

As described above, the predetermined number of times M serving as the first driving amount by which the agitating conveyance portion 203 is driven each time the toner cartridge 14 is driven for one cycle in the supply operation of toner in the developer supplying device 200Y is set to be variable between each stage. That is, the control portion 100 respectively sets the predetermined number of times M for the stages 1, 2, and 3 to 0, 5, and 1 in accordance with the amount of remaining toner in the toner cartridge 14.

Thus, in accordance with the change of the discharge property according to the amount of remaining toner in the toner cartridge 14, the formation of the heap of toner in the container 202 of the hopper 201 can be suppressed, or the heap of toner can be appropriately leveled before the heap increases in size. As a result of this, erroneous detection by the toner sensor 17 can be suppressed. In addition, the heap of toner coming into contact with the rotating toner cartridge 14 in the vicinity of the supply port 14*a* of the toner cartridge 14 can be suppressed without agitating the toner in the hopper 201 the whole time, and thus the deterioration of toner can be suppressed. In this way, in the present exemplary embodiment, the detection of toner can be appropriately performed by the toner sensor 17 while suppressing the deterioration of toner.

To be noted, the first driving amount and the counts of times of supply to the developing unit 613Y for transition between the stages 1 to 3 can be changed as appropriate in accordance with the properties of the toner. Here, the first driving amount corresponds to the predetermined number of times used in step S9, and the counts of times of supply corresponds to the amount of remaining toner in the toner cartridge 14. In addition, the amount of remaining toner in the toner cartridge 14 used for the transition between the stages 1 to 3 can be changed as appropriate in accordance with the shape of the toner cartridge 14, the shape of the hopper 201, and the placement of the toner sensor 17. Further, although the amount of remaining toner has been divided into three stages in the description above, the first driving amount may be appropriately set by dividing the amount of remaining toner into plural stages different from the three stages.

Second Exemplary Embodiment

A second exemplary embodiment will be described with reference to FIG. 18 and also to FIGS. 1 to 17. In the present exemplary embodiment, the detection of the amount of remaining toner in the toner cartridge 14 for the transition between the stages 1 to 3 is performed by using an accumulated number of rotations of the toner cartridge 14. That is, the control portion 100 calculates the amount of remaining toner in the toner cartridge 14 from the accumulated number of rotations of the toner cartridge 14 serving as a driving amount.

Figure 18:
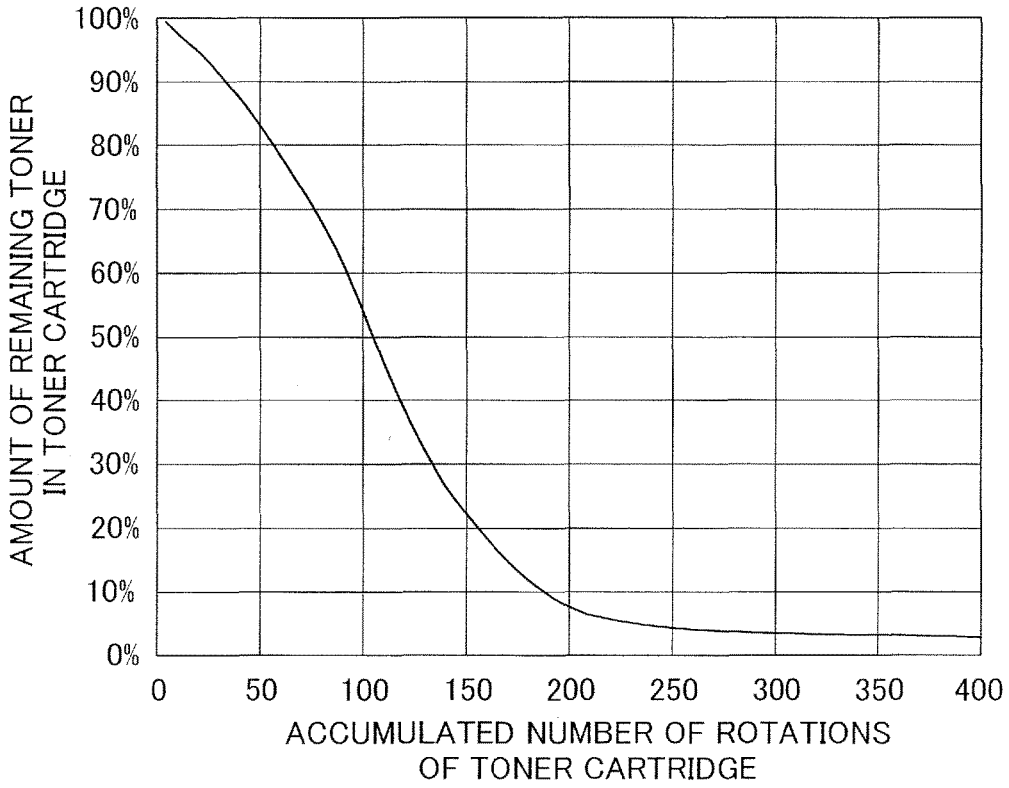
FIG. 18 illustrates a relationship between accumulated numbers of rotations of and amounts of toner remaining in a toner cartridge according to a second exemplary embodiment.
Figure 19:
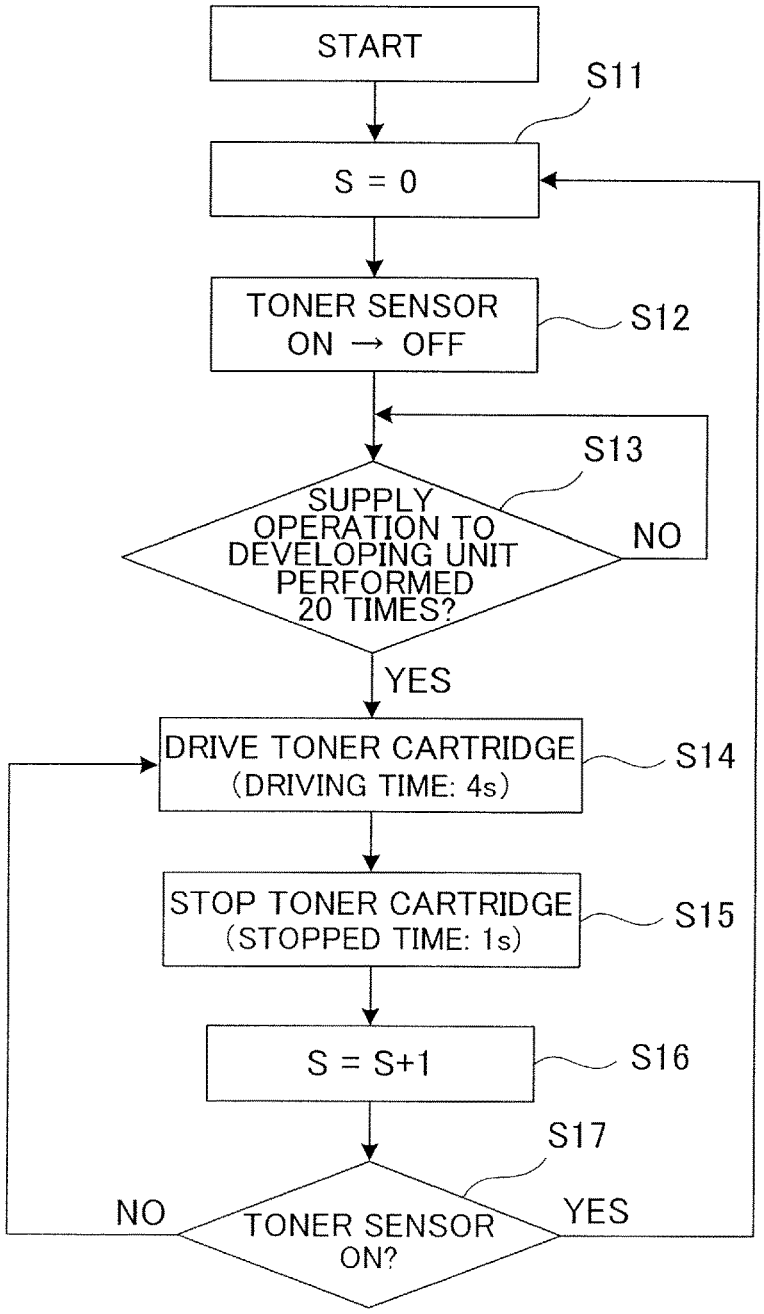
FIG. 19 is a flowchart illustrating a flow of control of a developer supplying device according to a third exemplary embodiment.

The accumulated number of rotations of the toner cartridge 14 serving as a driving amount and the amount of remaining toner in the toner cartridge 14 have a relationship illustrated in FIG. 18. Thus, the amount of remaining toner in the toner cartridge 14 is calculated from the driving time of the toner cartridge 14 by setting this relationship as a table. That is, this table is stored in, for example, a memory such as the RAM 103. Meanwhile, the CPU 101 counts the accumulated number of rotations of the toner cartridge 14. Then, the CPU 101 refers to the table to obtain the amount of remaining toner in the toner cartridge 14 from the accumulated number of rotations of the toner cartridge 14 that has been counted. For example, in the case where the accumulated number of rotations of the toner cartridge 14 that has been counted since replacement by a new toner cartridge is 100, the amount of remaining toner can be calculated as 55% from the table illustrated in FIG. 18.

The control portion 100 determines in which of the stages 1 to 3 the developer supplying device 200Y is from the amount of remaining toner in the toner cartridge 14 calculated in this way in a similar manner to the first exemplary embodiment, and sets the first driving amount in accordance with the determined stage. The other points of the configuration and the effect are similar to the first exemplary embodiment.

To be noted, the amount of remaining toner may be detected by counting the driving time in which the toner cartridge 14 is driven instead of the accumulated number of rotations of the toner cartridge 14. In addition, the detection of the amount of remaining toner may be performed by measuring the weight of the toner cartridge 14. For example, the amount of remaining toner in the toner cartridge 14 may be directly measured by attaching a weight detection sensor such as a load cell to the tray 26 or the rollers 25 illustrated in FIGS. 7 and 8.

Third Exemplary Embodiment

A third exemplary embodiment will be described with reference to FIGS. 19 and 20A to 20C and also to FIGS. 1 to 15 and 17. In the first and second exemplary embodiments described above, the first driving amount is set by using the relationship between the amount of remaining toner in the toner cartridge 14 and the supplying property, or, the discharge property, of the toner cartridge 14. In contrast, in the present exemplary embodiment, the first driving amount is set by detecting the amount of toner supplied from the toner cartridge 14 to the container 202 of the hopper 201 per unit time.

Thus, the control portion 100 can execute a supplied amount detecting mode. In the supplied amount detecting mode, the agitating conveyance portion 203 is driven by a predetermined amount without driving the toner cartridge 14 in the case where the state of the toner sensor 17 has changed from a state of detecting toner to a state of not detecting toner, that is, from the on state to the off state. Along with this operation, after the agitating conveyance portion 203 has been driven by the predetermined amount, the toner cartridge 14 is driven until the toner sensor 17 detects toner without driving the agitating conveyance portion 203. Then, the control portion 100 calculates the amount of developer supplied per unit time from a relationship between a predetermined amount and the driving amount by which the toner cartridge 14 has been driven in the supplied amount detecting mode.

That is, in the supplied amount detecting mode, a certain amount of toner is discharged from the hopper 201 to the developing unit 613Y by driving the agitating conveyance portion 203 by a predetermined amount from a time point at which the state of the toner sensor 17 has changed to the off state. At this time, the amount of toner in the container 202 of the hopper 201 is reduced by the certain amount from the time point at which the state of the toner sensor 17 has changed to the off state. Then, the toner cartridge 14 is started being driven in this state, and toner is supplied from the toner cartridge 14 to the container 202 until the state of the toner sensor 17 changes to the on state. At this time, the agitating conveyance portion 203 is not driven, and thus toner is not discharged from the container 202. Thus, the number of rotations or the rotating time which serves as a driving amount and by which or for which the toner cartridge 14 has been driven to supply toner of the certain amount described above from the toner cartridge 14 can be obtained. As a result of this, the amount of toner supplied from the toner cartridge 14 per unit time in the case where the supplied amount detecting mode is executed can be calculated.

The control portion 100 sets different values of the first driving amount on the basis of the amount of toner supplied per unit time that has been calculated in this way. That is, the control portion 100 sets the first driving amount to a first amount in the case where the amount of toner supplied per unit time is equal to or larger than a threshold value, and sets the first driving amount to a second amount smaller than the first amount in the case where the amount of toner supplied per unit time is smaller than the threshold value. For example, the case where the amount of toner supplied per unit time is equal to or larger than the threshold value is set as the stage 2, and the case where the amount of toner supplied per unit time is smaller than the threshold value is set as the stage 3.

In addition, the control portion 100 integrates the driving amount of the toner cartridge 14. That is, an accumulated number of rotations or driving time of the toner cartridge 14 is counted. Then, in the case where the integrated driving amount of the toner cartridge 14 is smaller than a predetermined driving amount, the control portion 100 sets the first driving amount to 0 without performing detection of the amount of toner supplied from the toner cartridge 14 per unit time. That is, in the stage 1, for example, immediately after replacement, in which the amount of remaining toner in the toner cartridge 14 is large, the control portion 100 sets the first driving amount to 0 without executing the supplied amount detecting mode.

Figure 17:
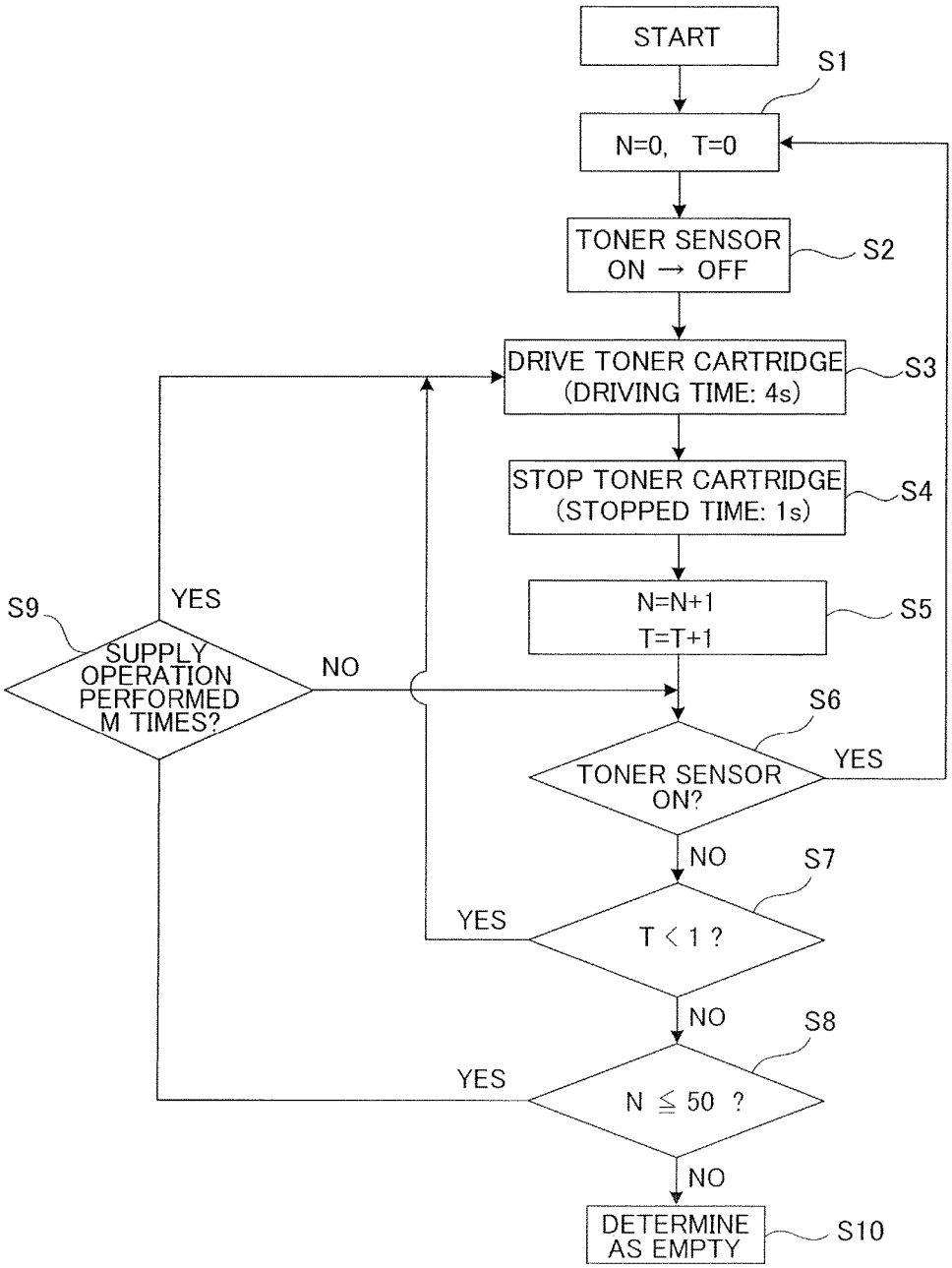
FIG. 17 is a flowchart illustrating a flow of control of the developer supplying device according to the first exemplary embodiment.

As described above, transition between the stages 1 to 3 is performed on the basis of the amount of toner supplied per unit time and the driving amount of the toner cartridge 14, and the flow illustrated in FIG. 17 is performed. The supplied amount detection mode will be described in detail with reference to FIGS. 19 and 20A to 20C.

First, as preparation for driving of the toner cartridge 14, a count S of times of driving of the toner cartridge 14 is set to 0 in step S11. Next, in the case where toner is supplied from the hopper 201 to the developing unit 613Y and the state of the toner sensor 17 is changed to a state in which toner is not detected, that is, the off state, in step S12, the control portion 100 outputs a command to drive the motor 22, and the agitating conveyance portion 203 starts driving. In step S12, the powder surface of the toner t in the container 202 of the hopper 201 takes a state illustrated in FIG. 20A.

Next, the supply operation of toner from the hopper 201 to the developing unit 613Y is performed twenty times in step S13. That is, the second screw 13 of the agitating conveyance portion 203 rotates twenty times. The twenty times serves as a predetermined amount. At this time, the toner cartridge 14 is not driven until the supply operation of toner is performed twenty times in total. In addition, in the case where the amount of toner supplied by one rotation of the second screw 13 is represented by Q, the amount of toner supplied from the hopper 201 to the developing unit 613Y by performing the supply operation of toner twenty times is 20Q. In the case where a result of determination of whether the supply operation has been performed twenty times in step S13 is YES, the powder surface of the toner t in the container 202 of the hopper 201 takes a state illustrated in FIG. 20B. That is, the amount of toner in the container 202 of the hopper 201 is reduced by 20Q serving as the certain amount from the time point at which the state of the toner sensor 17 has changed to the off state.

After the supply operation of toner has been performed twenty times, the control portion 100 outputs a command to drive the motor 21, and the toner cartridge 14 starts driving. At this time, the toner cartridge 14 keeps on driving for four seconds in step S14, and then stops for one second in step S15. The driving and stopping of the toner cartridge 14 of steps S14 and S15 will be defined as one cycle.

After the toner cartridge 14 has been driven for one cycle, the count S of times of driving of the toner cartridge 14 is increased by one, that is, S=S+1 is performed in step S16. Next, the state of the toner sensor 17 is checked in step S17. In the case where the toner sensor 17 is in the state of detecting toner, that is, the on state, information indicating the state is transmitted to the control portion 100, the process returns to step S11, and the count S of times of driving of the toner cartridge 14 is reset to 0. Then, the developer supplying device 200Y takes a stand-by state until the state of the toner sensor 17 changes to the off state again in accordance with the supply operation from the hopper 201 to the developing unit 613Y.

In contrast, in the case where the toner sensor 17 is still in the off state in step S17, the process returns to step S14, one cycle of the driving and stopping of the toner cartridge 14 is performed in steps S14 and S15, and the count S is further increased by 1 in step S16. Then, the state of the toner sensor 17 is checked again in step S17. In the case where the toner sensor 17 is still in the off state, the cycle from step S14 to step S17 is repeated until the state of the toner sensor 17 changes to the on state, and the count S is increased each time the cycle is repeated. In the case where a result of determination of whether the state of the toner sensor 17 has changed to the on state in step S17 is YES, the powder surface of the toner t in the container 202 of the hopper 201 is in a state illustrated in FIG. 20C. That is, toner of an amount approximately equal to 20Q has been supplied from the toner cartridge 14 to the container 202 of the hopper 201 by driving the toner cartridge 14 S times corresponding to the count S.

Figure 20A:
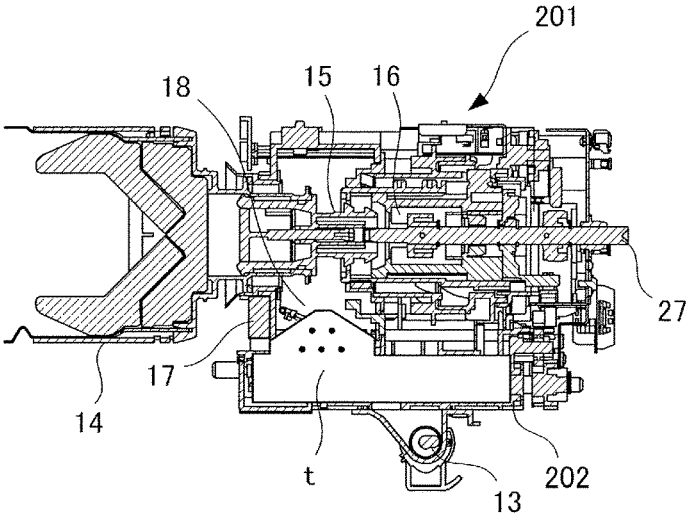
FIG. 20A is a section view of the hopper illustrating a state of a powder surface of toner in the hopper when the toner detection sensor is in an off state in the third exemplary embodiment.
Figure 20B:
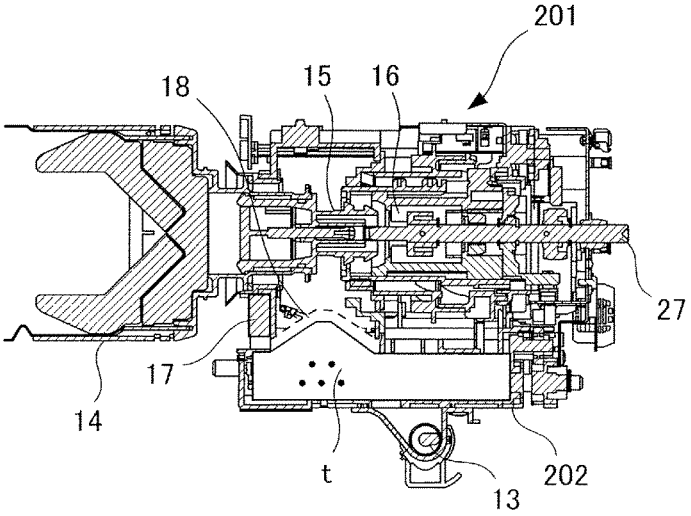
FIG. 20B is a section view of the hopper illustrating a state of the powder surface of toner in the hopper after a supply operation to a developing unit is performed twenty times in the third exemplary embodiment.
Figure 20C:
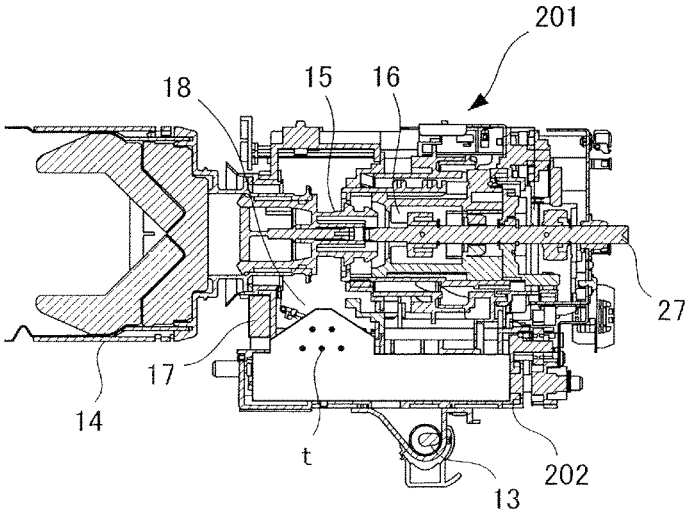
FIG. 20C is a section view of the hopper illustrating a state of the powder surface of toner in the hopper when the toner detection sensor is in an on state after supplying toner to the hopper in the third exemplary embodiment.

Here, since the toner cartridge 14 is driven for four seconds each time in step S14, an accumulated driving time of the toner cartridge 14 from the state illustrated in FIG. 20A to the state illustrated in FIG. 20C is 4S seconds. Accordingly, in the supplied amount detecting mode, the amount E g/s of toner supplied, or, discharged, from the toner cartridge 14 per unit time can be obtained by the following equation.

$$E = \frac{20Q}{4S} \quad \text{(g/s)}$$

In the case where E obtained by this equation is equal to or larger than a threshold value that is 5 g/s in this case, the sequence for the stage 2 of the first exemplary embodiment is performed. That is, the predetermined number of times M serving as the first driving amount is set to 5 serving as the first amount, and the flow illustrated in FIG. 17 is performed. In addition, in the case where E is smaller than the threshold value, the sequence for the stage 3 of the first exemplary embodiment is performed. That is, the predetermined number of times M serving as the first driving amount is set to 1 serving as the second amount, and the flow illustrated in FIG. 17 is performed.

In the case where the accumulated number of rotations after replacement of the toner cartridge 14 is smaller than 100 serving as a predetermined driving amount, the sequence for the stage 1 of the first exemplary embodiment is performed without executing the supplied amount detecting mode. That is, the predetermined number of times M serving as the first driving amount is set to 0, and the flow illustrated in FIG. 17 is performed. In other words, the sequence of the stage 1 is performed until the first execution of the supplied amount detecting mode, that is, while the number of times of driving of the toner cartridge 14 is smaller than 100.

According to this, supply control of toner can be appropriately performed even in the case where the supplying property cartridge 14 is different from an expected property due to the time or environment for or in which the toner cartridge 14 has been stored, the environment in which the image forming apparatus 60 is used, or the like. As a result of this, formation of the heap of toner in the container 202 of the hopper 201 can be suppressed, and detection of toner can be appropriately performed by the toner sensor 17 while suppressing deterioration of toner. The other elements and effects are similar to the first exemplary embodiment.

Other Embodiments

Although, cases where two-component developer including toner and carrier is used as developer has been described in the exemplary embodiments described above, the developer may be one-component developer including toner.

It has been described above that toner is supplied to a developer accommodating portion by a spiral groove defined in a toner cartridge configured to supply toner by rotating. However, the configuration of supplying toner to the developer accommodating portion may be, for example, a configuration in which a conveyance member such as a screw configured to convey toner is provided in the toner cartridge serving as a developer supplying container. In addition, in the case where the toner cartridge is not configured to rotate, a configuration in which a sensor such as a pressure sensor capable of detecting toner is provided at a predetermined height in the toner cartridge and the amount of remaining toner in the toner cartridge is directly detected may be employed.

In addition, although a case where the agitating conveyance portion 203 is constituted by the agitating screws 11 and the first and second screws 12 and 13 has been described, the agitating conveyance portion 203 may be constituted by an agitating conveyance member such as one screw. For example, a discharge screw that discharges toner from a hopper to a developing unit may be configured to include a spiral blade provided around a rotation shaft and ribs for agitation provided at gaps in the spiral blade. According to this, agitation and conveyance of developer in the hopper are performed by one screw.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No.2016-138698, filed Jul. 13, 2016, which is hereby incorporated by reference wherein in its entirety.

What is claimed is:

1. A developer supplying device comprising:

a developer supplying container attachable to and detachable from an image forming apparatus and comprising a rotatable container body configured to accommodate developer;

a developer storing portion configured to store the developer supplied from the developer supplying container and provided with a discharge port through which the developer in the developer storing portion is discharged;

a developing device configured to develop an electrostatic latent image on an image bearing member by applying the developer supplied from the developer storing portion;

a toner detection portion configured to detect a density of toner contained in the developer within the developing device;

a conveyance screw provided in the developer storing portion and configured to convey the developer such that the developer is supplied to the developing device through the discharge port;

a first supplying portion configured to rotate the conveyance screw so as to carry out a first supplying operation by which the conveyance screw is rotated based on an output of the toner detection portion such that the developer is supplied from the developer storing portion to the developing device;

a developer detection portion configured to detect an amount of the developer within the developer storing portion;

a second supplying portion configured to rotate the container body of the developer supplying container so as to carry out a second supplying operation by which the developer is supplied from the developer supplying container to the developer storing portion, wherein one cycle of the second supplying operation includes rotating the container body of the developer supplying container by a predetermined amount and stopping the container body; and an execution portion configured to execute a supply sequence, in a case where the developer is not detected by the developer detection portion, in which a set of operations including at least one time of the first supplying operation and a predetermined number of times of the second supplying operation is performed repeatedly until the developer detection portion detects the developer, wherein the execution portion is configured to switch modes of the supply sequence from a first mode to a second mode in response to decrease of the developer within the developer supplying container, wherein in the first mode, the second supplying operation is executed the predetermined number of times after the first supplying operation is executed a first number of times, and wherein in the second mode, the second supplying operation is executed the predetermined number of times after the first supplying operation is executed a second number of times smaller than the first number of times.

2. The image forming apparatus according to claim 1, further comprising a rotation counter configured to count a number of times that the container body of the developer supplying container is rotated, wherein the execution portion is configured to switch from the first mode to the second mode in a case where the number of times counted by the rotation counter reaches a predetermined number.

3. The image forming apparatus according to claim 1, wherein the execution portion is configured such that after the developer supplying container is replaced, the second supplying operation is performed regardless of the first supplying operation until the developer detection portion detects the developer.

4. The image forming apparatus according to claim 1, wherein the predetermined number is one.

5. The image forming apparatus according to claim 1, wherein one cycle of the first supplying operation is defined as a period of time from when the conveyance screw starts rotation to when the conveyance screw stops rotation.

6. A developer supplying device comprising:

a developer supplying container attachable to and detachable from an image forming apparatus and comprising a rotatable container body configured to accommodate developer;

a developer storing portion configured to store the developer supplied from the developer supplying container and provided with a discharge port through which the developer in the developer storing portion is discharged;

a developing device configured to develop an electrostatic latent image on an image bearing member by applying the developer supplied from the developer storing portion;

a toner detection portion configured to detect a density of toner contained in the developer within the developing device;

a conveyance screw provided in the developer storing portion and configured to convey the developer such that the developer is supplied to the developing device through the discharge port;

a first supplying portion configured to rotate the conveyance screw so as to carry out a first supplying operation by which the conveyance screw is rotated based on an output of the toner detection portion such that the developer is supplied from the developer storing portion to the developing device;

a developer detection portion configured to detect an amount of the developer within the developer storing portion;

a second supplying portion configured to rotate the container body of the developer supplying container so as to carry out a second supplying operation by which the developer is supplied from the developer supplying container to the developer storing portion, wherein one cycle of the second supplying operation includes rotating the container body of the developer supplying container by a predetermined amount and stopping the container body; and an execution portion configured to execute a supply sequence in a case where the developer is not detected by the developer detection portion, wherein the execution portion is configured to execute the supply sequence among a plurality of modes, including a first mode in which the second supplying operation is performed regardless of the first supplying operation until the developer detection portion detects the developer, and a second mode in which a set of operations including at least one time the first supplying operation and a predetermined time of the second supplying operation is performed repeatedly until the developer detection portion detects the developer.

7. An image forming apparatus comprising:

a developing unit configured to develop a latent image on an image bearing member with toner;

a toner container configured to contain the toner and provided with a discharge port through which the toner contained in the toner container is discharged;

a supplying unit configured to store the toner discharged from the toner container through the discharge port and comprising a supply screw configured to supply the toner stored in the supplying unit to the developing unit;

a detection portion provided in the supplying unit and configured to detect information about an amount of the toner stored in the supplying unit;

a first driving portion configured to drive and rotate the toner container;

a second driving portion configured to drive and rotate the supply screw; and a control portion configured to control each of the first driving portion and the second driving portion, wherein the control portion is capable of executing each of a discharge operation of discharging the toner in the toner container to the supplying unit through the discharge port by operating the first driving portion to drive the toner container based on a detection result of the detection portion, and a supply operation of supplying the toner stored in the supplying unit to the developing unit by operating the second driving portion to drive the supply screw based on information about an amount of toner to be supplied to the developing unit, and wherein the control portion is configured to execute, when a predetermined condition including a condition that a remaining amount of the toner remaining in the toner container is less than a predetermined amount is satisfied, a mode in which execution of a next round of the discharge operation is restricted since a previous round of the discharge operation has been executed until the supply operation is executed, and then execution of the next round of the discharge operation is permitted in response to execution of the supply operation.

8. An image forming apparatus comprising:

a developing unit configured to develop a latent image on an image bearing member with toner;

a toner container configured to contain the toner and provided with a discharge port through which the toner contained in the toner container is discharged;

a supplying unit configured to store the toner discharged from the toner container through the discharge port and comprising a supply screw configured to supply the toner stored in the supplying unit to the developing unit;

a detection portion provided in the supplying unit and configured to detect information about an amount of the toner stored in the supplying unit;

a first driving portion configured to drive and rotate the toner container;

a second driving portion configured to drive and rotate the supply screw; and a control portion configured to control each of the first driving portion and the second driving portion, wherein the control portion is capable of executing each of a discharge operation of discharging the toner in the toner container to the supplying unit through the discharge port by operating the first driving portion to drive the toner container based on a detection result of the detection portion, and a supply operation of supplying the toner stored in the supplying unit to the developing unit by operating the second driving portion to drive the supply screw based on information about an amount of toner to be supplied to the developing unit, and wherein the control portion is configured to execute, when a predetermined condition including a condition that an accumulated number of rotations of a new toner container reaches a predetermined number is satisfied, a mode in which execution of a next round of the discharge operation is restricted since a previous round of the discharge operation has been executed until the supply operation is executed, and then execution of the next round of the discharge operation is permitted in response to execution of the supply operation.

9. An image forming apparatus comprising:

a developing unit configured to develop a latent image on an image bearing member with toner;

a toner container configured to contain the toner and provided with a discharge port through which the toner contained in the toner container is discharged;

a supplying unit configured to store the toner discharged from the toner container through the discharge port and comprising a supply screw configured to supply the toner stored in the supplying unit to the developing unit;

a detection portion provided in the supplying unit and configured to detect information about an amount of the toner stored in the supplying unit;

a first driving portion configured to drive and rotate the toner container;

a second driving portion configured to drive and rotate the supply screw; and a control portion configured to control each of the first driving portion and the second driving portion, wherein the control portion is capable of executing each of a discharge operation of discharging the toner in the toner container to the supplying unit through the discharge port by operating the first driving portion to drive the toner container based on a detection result of the detection portion indicating that the amount of the toner stored in the supplying unit is less than a predetermined amount, and a supply operation of supplying the toner stored in the supplying unit to the developing unit by operating the second driving portion to drive the supply screw based on information about an amount of toner to be supplied to the developing unit, and wherein the control portion is configured to execute, when a predetermined condition including a condition that the detection result of the detection portion indicates that the amount of the toner stored in the supplying unit is less than the predetermined amount even after a round of the discharge operation is repeated a predetermined number of times is satisfied, a mode in which execution of a next round of the discharge operation is restricted since a previous round of the discharge operation has been executed until the supply operation is executed, and then execution of the next round of the discharge operation is permitted in response to execution of the supply operation.

* * * * *